US011717087B1

(12) United States Patent
Flannery et al.

(10) Patent No.: US 11,717,087 B1
(45) Date of Patent: Aug. 8, 2023

(54) CHARACTER CHAIR

(71) Applicant: Regalo International, LLC, Longboat Key, FL (US)

(72) Inventors: Mark A. Flannery, Longboat Key, FL (US); William D. Butterfield, River Falls, WI (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 17/892,074

(22) Filed: Aug. 20, 2022

Related U.S. Application Data

(63) Continuation of application No. 17/163,491, filed on Jan. 31, 2021, now Pat. No. 11,419,419, which is a continuation of application No. 16/378,487, filed on Apr. 8, 2019, now Pat. No. 10,905,242.

(60) Provisional application No. 62/655,079, filed on Apr. 9, 2018.

(51) Int. Cl.

| | |
|---|---|
| ***A47C 4/20*** | (2006.01) |
| ***A47C 4/28*** | (2006.01) |
| *A47C 7/62* | (2006.01) |
| *A47C 7/02* | (2006.01) |
| *A47D 15/00* | (2006.01) |
| *A63G 9/10* | (2006.01) |
| *A63G 9/16* | (2006.01) |
| *A47D 1/00* | (2006.01) |

(52) U.S. Cl.
CPC ..... *A47C 4/28* (2013.01); *A47C 7/02* (2013.01); *A47C 7/622* (2018.08); *A47D 1/00* (2013.01); *A47D 15/00* (2013.01); *A63G 9/10* (2013.01); *A63G 9/16* (2013.01)

(58) Field of Classification Search
CPC .. A47C 7/28; A47C 7/50; A47D 15/00; A47D 1/00; A69G 9/10; A69G 9/16
See application file for complete search history.

(56) References Cited

U.S. PATENT DOCUMENTS

| | | | | |
|---|---|---|---|---|
| 6,126,240 | A | 10/2000 | Tse | |
| 6,382,715 | B1 * | 5/2002 | Tang | A47C 4/286 297/16.2 |
| 6,402,230 | B1 | 6/2002 | Tang | |
| 6,454,348 | B1 * | 9/2002 | Wu | A47C 4/286 297/16.2 |
| 6,629,722 | B1 | 10/2003 | Tang | |
| 6,733,070 | B2 | 5/2004 | Chang | |
| 7,189,164 | B1 | 3/2007 | Paesang | |
| 7,422,276 | B2 | 9/2008 | Flannery | |
| 7,845,720 | B2 | 12/2010 | Randall | |
| 8,246,115 | B1 | 8/2012 | Loyer | |
| 8,556,349 | B2 | 10/2013 | Welch | |
| 9,420,898 | B2 | 8/2016 | Schechtman | |
| 9,723,812 | B2 * | 8/2017 | Jones | A01K 5/0114 |
| 10,159,356 | B1 | 12/2018 | Flannery | |
| 2001/0035671 | A1 | 11/2001 | Brooks | |

* cited by examiner

*Primary Examiner* — Syed A Islam

(57) ABSTRACT

The present chair includes a scissoring straight leg and oblique support mechanism such that the chair may be folded between open and closed forms. The straight legs include lower feet and upper hubs. The oblique supports extend between the lower feet and upper hubs. The lower feet include structures that provide character to the folding chair.

17 Claims, 17 Drawing Sheets

FIG. 4A
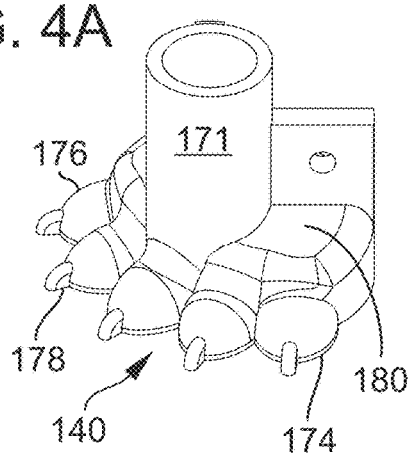
FIG. 4B
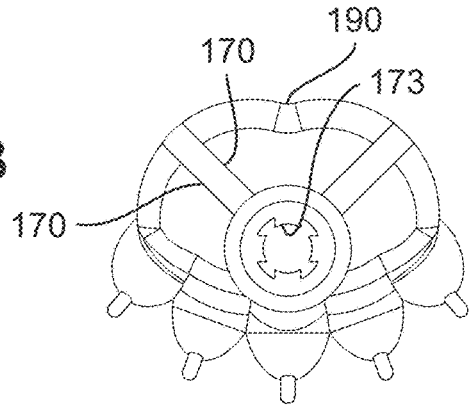
FIG. 4C
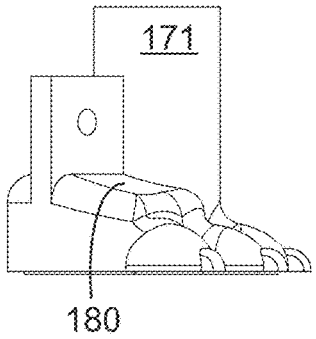
FIG. 4D
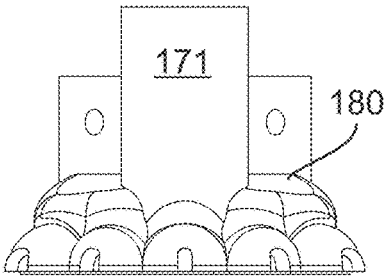
FIG. 4E
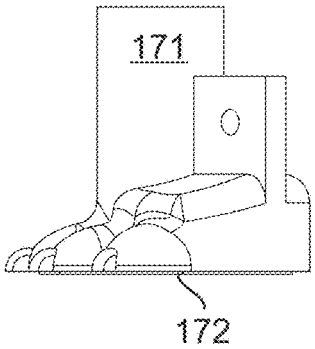
FIG. 4F
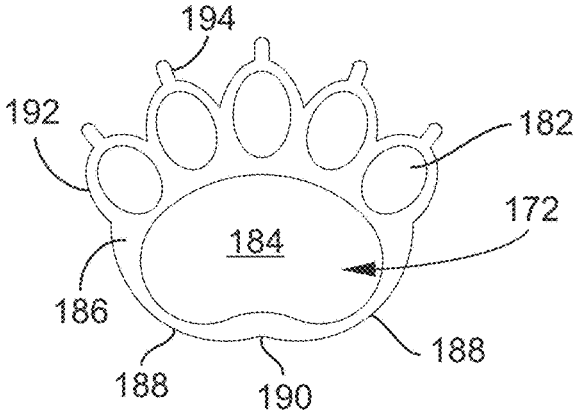
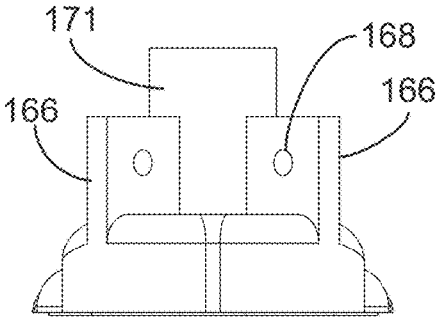
FIG. 4G FIG. 8A
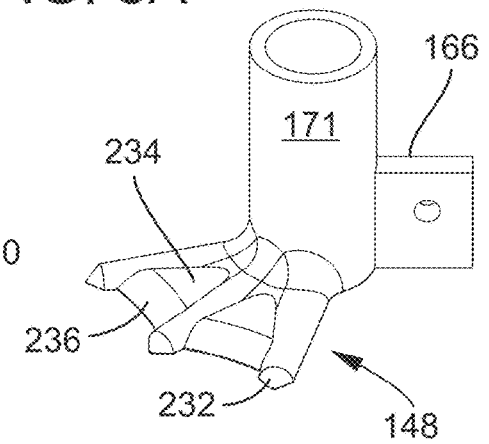
FIG. 8B
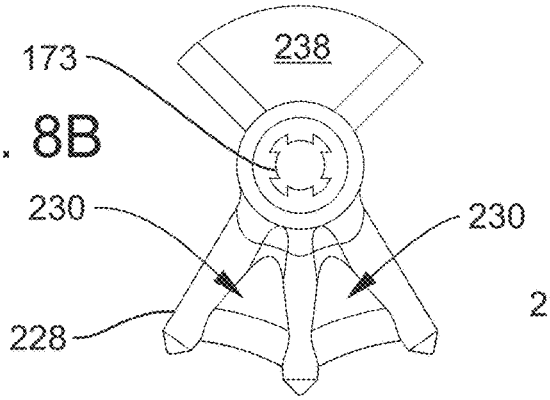
FIG. 8C
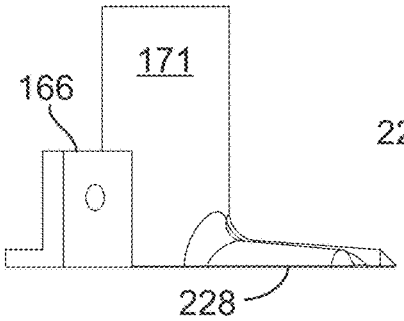
FIG. 8D
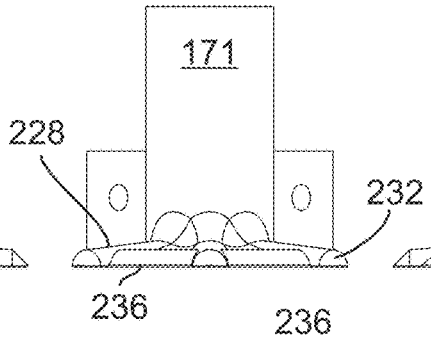
FIG. 8E
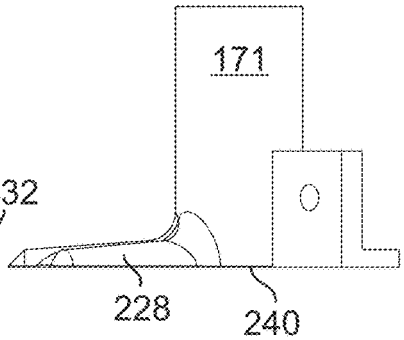
FIG. 8F
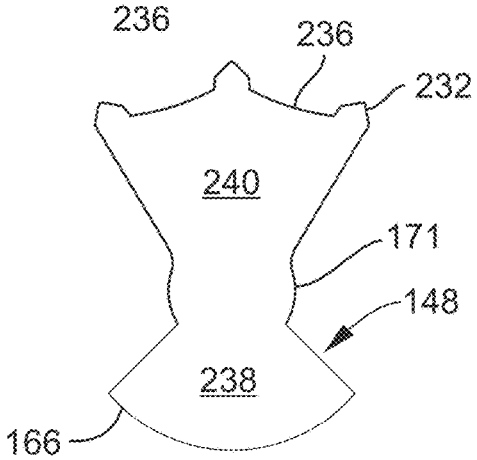
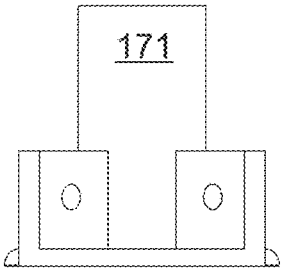
FIG. 8G FIG. 9A
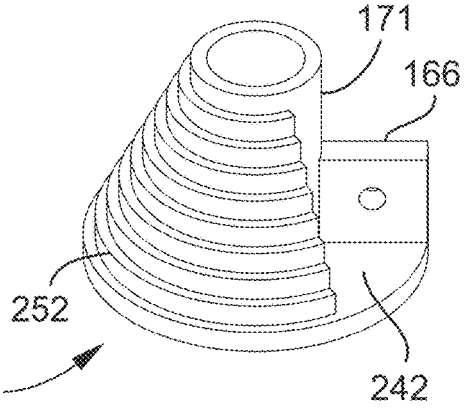
FIG. 9B
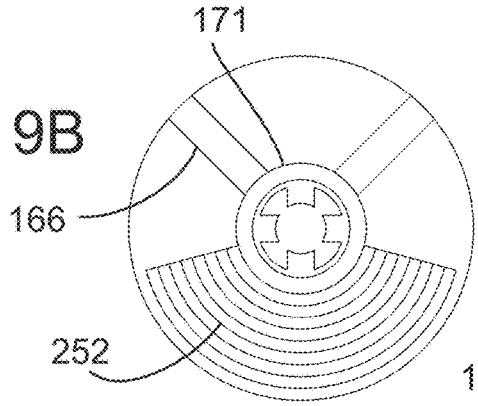
FIG. 9C
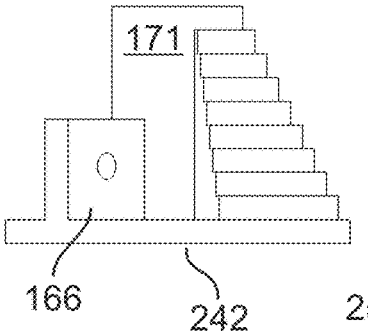
FIG. 9D
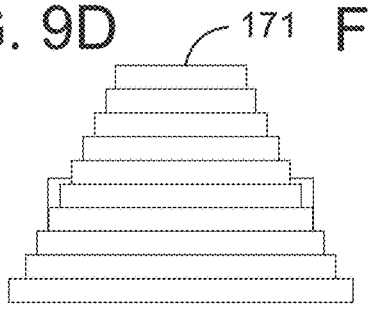
FIG. 9E
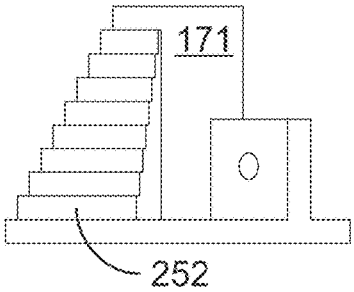
FIG. 9F
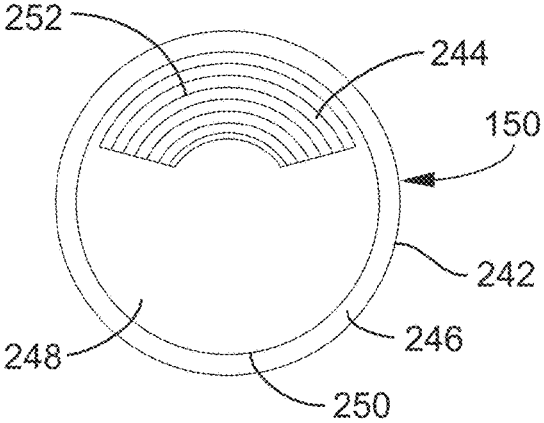
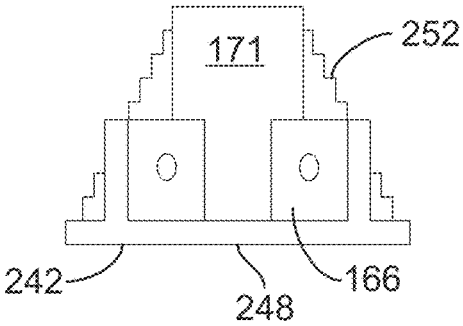
FIG. 9G FIG. 11A
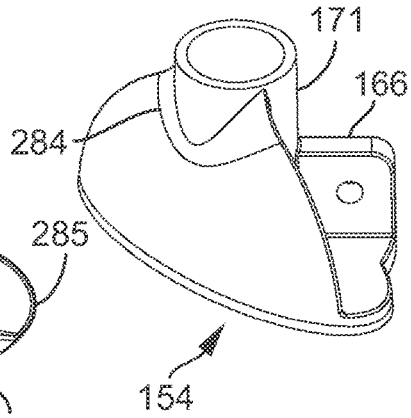
FIG. 11B
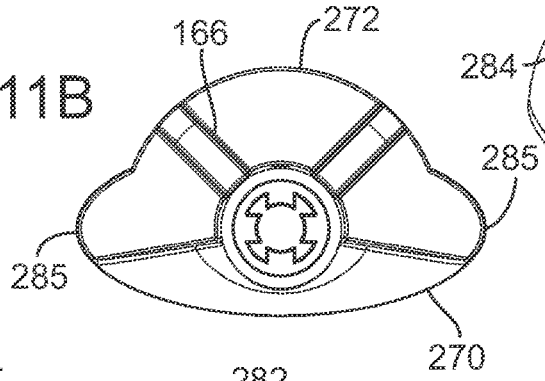
FIG. 11C
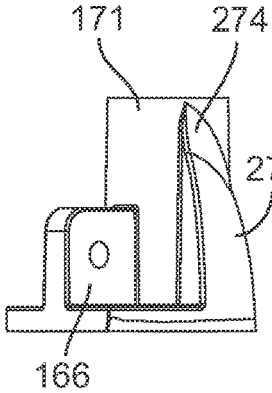
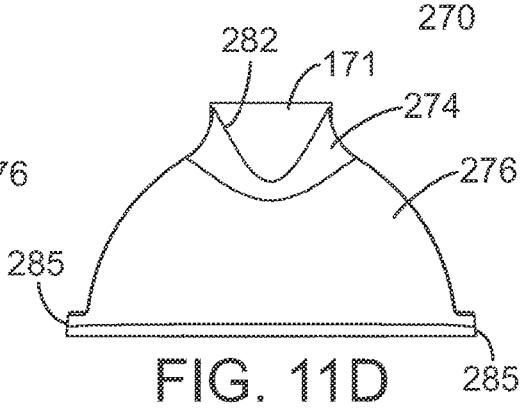
FIG. 11D
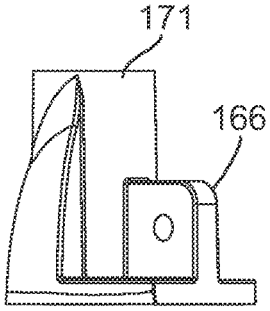
FIG. 11E
FIG. 11F
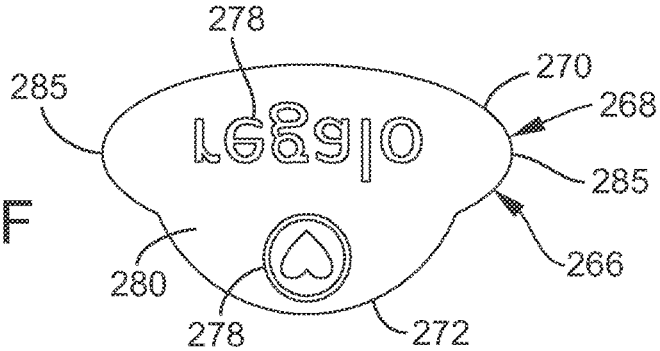
FIG. 11G
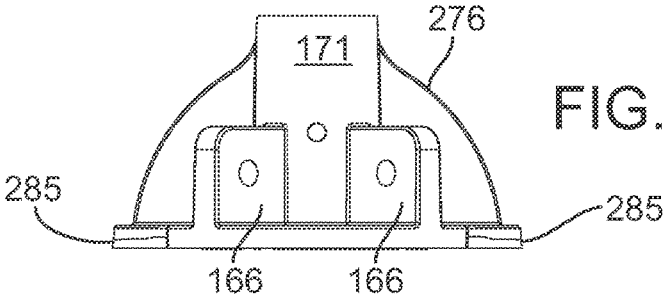

FIG. 13A
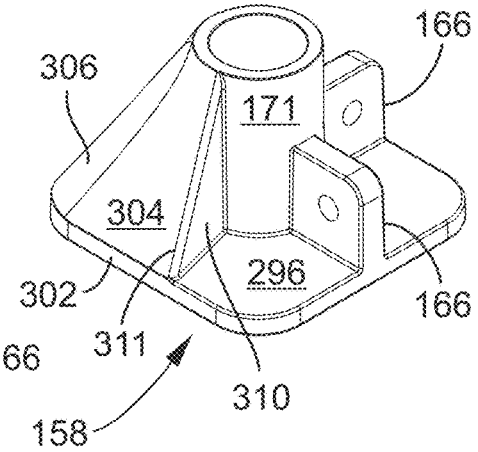
FIG. 13B
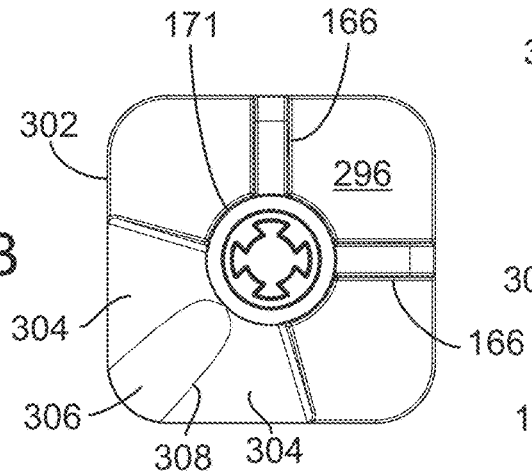
FIG. 13C
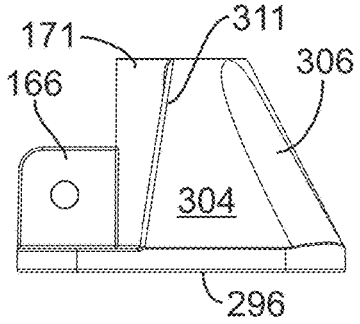
FIG. 13D
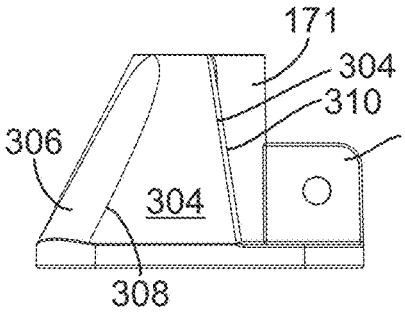
FIG. 13E
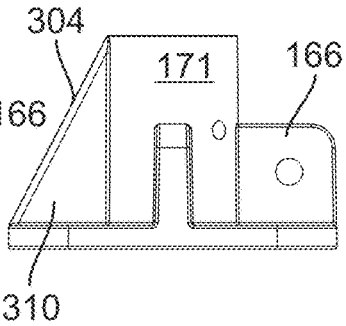
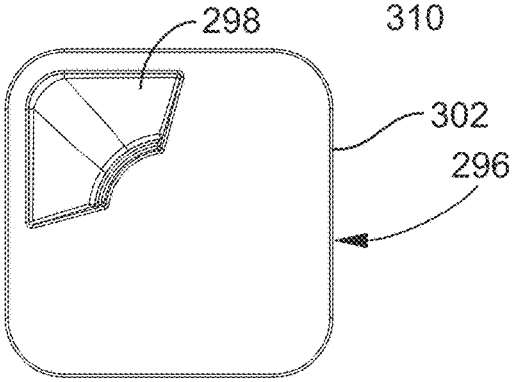
FIG. 13F
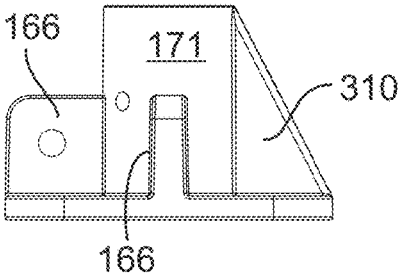
FIG. 13G FIG. 14A
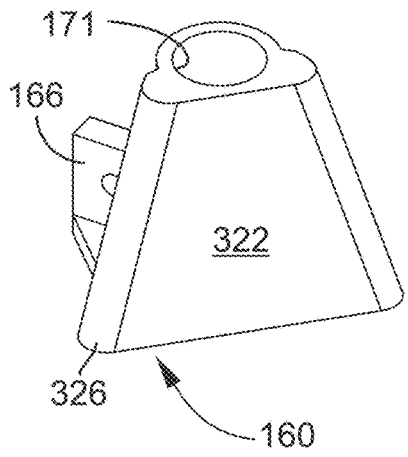
FIG. 14B
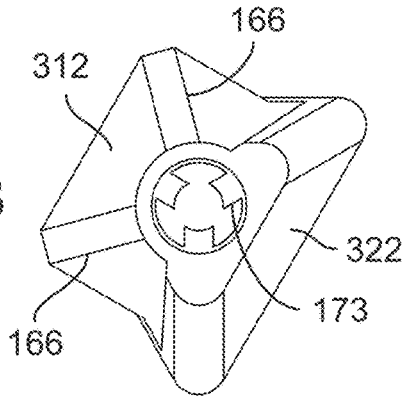
FIG. 14C
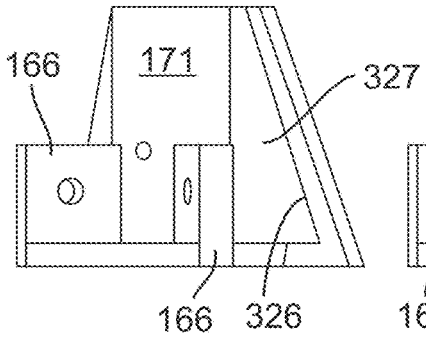
FIG. 14D
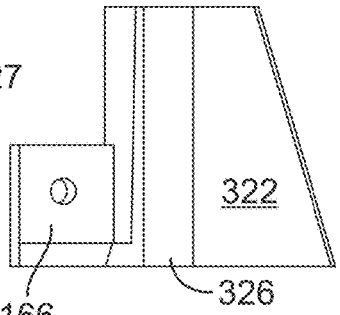
FIG. 14E
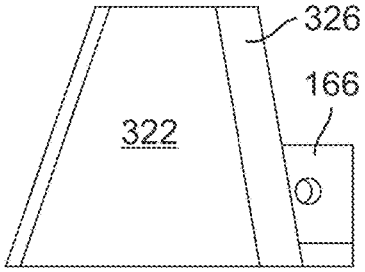
FIG. 14F
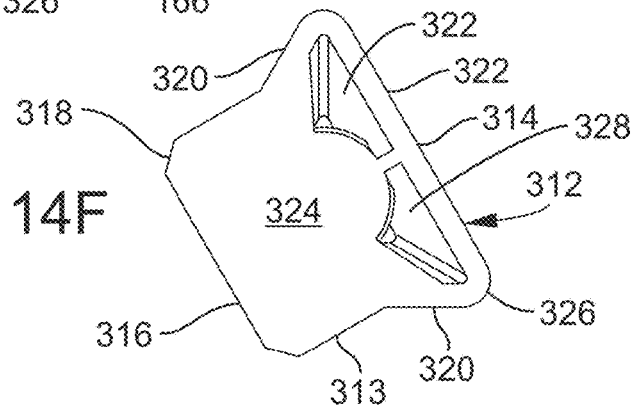
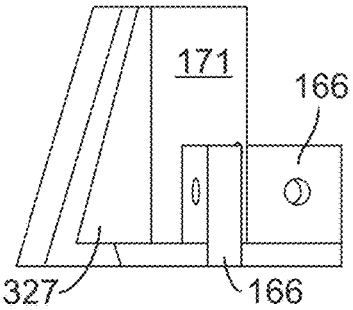
FIG. 14G FIG. 16A
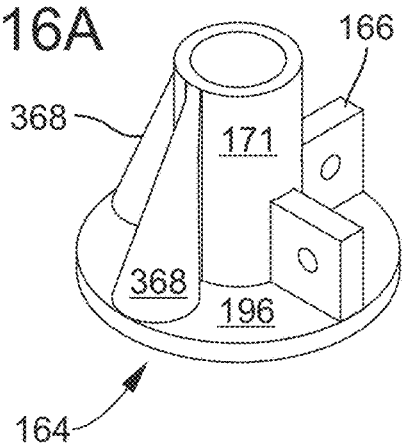
FIG. 16B
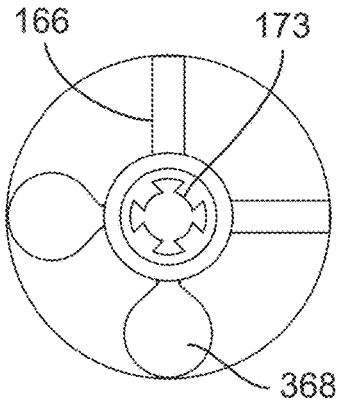
FIG. 16C
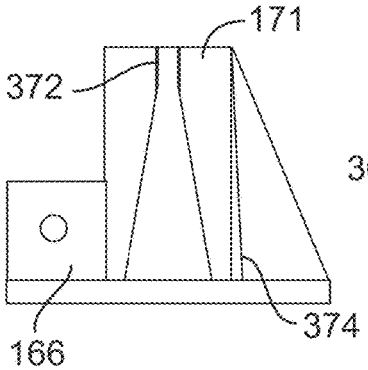
FIG. 16D
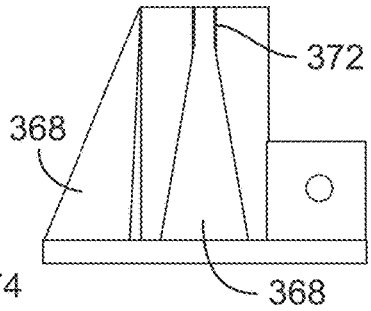
FIG. 16E
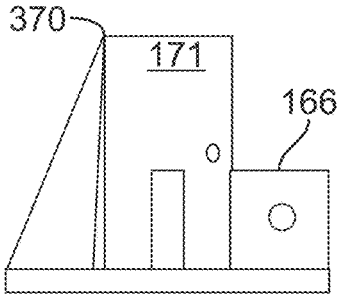
FIG. 16F
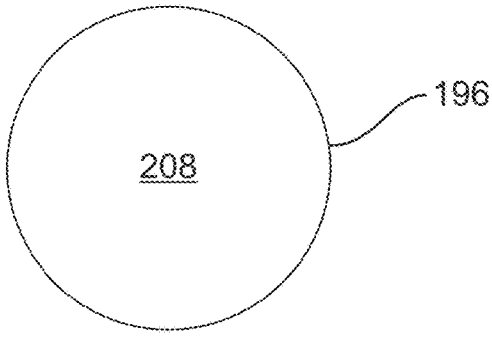
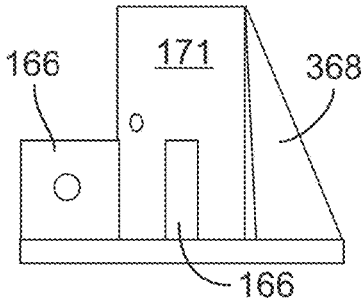
FIG. 16G

CHARACTER CHAIR

This application is a continuation of U.S. patent application Ser. No. 17/163,491 filed Jan. 31, 2021 (U.S. Pat. No. 11,419,419 issued Aug. 23, 2022) and claims the benefit thereof under 35 U.S.C. § 120, which application is a continuation of U.S. patent application Ser. No. 16/378,487 filed Apr. 8, 2019 (U.S. Pat. No. 10,905,242 issued Feb. 2, 2021) and claims the benefit thereof under 35 U.S.C. § 120, which application claims the benefit under 35 U.S.C. 119(e) of U.S. Provisional Patent Application No. 62/655,079 filed Apr. 9, 2018, with such applications being hereby incorporated by reference in their entireties into this application.

FIELD OF THE INVENTION

The present invention relates to chairs that have scissoring support arrangements to make the chairs foldable from a compact form to an operating form, and more particularly to the feet on the chairs that are utilized by the scissoring support arrangements.

BACKGROUND OF THE INVENTION

Common and ordinary objects are not necessarily required to be common and ordinary, especially where children are involved.

SUMMARY OF THE INVENTION

A feature of the present invention is a chair.

Another feature of the present invention is a chair for a child.

Another feature of the present invention is the provision in a chair for a child, of a flexible child sized receptacle for the child, where the flexible receptacle includes a seat portion and a back portion.

Another feature of the present invention is the provision in a chair for a child, of a set of first, second, third, and fourth vertical legs, where the flexible receptacle is engaged to the first, second, third, and fourth vertical legs.

Another feature of the present invention is the provision in a chair for a child, of a set of first, second, third, and fourth feet engaged, respectively, on the first, second, third, and fourth vertical legs.

Another feature of the present invention is the provision in a chair for a child, of a set of first, second, third, and fourth hubs engaged, respectively, on the first, second, third, and fourth vertical legs.

Another feature of the present invention is the provision in a chair for a child, of a pair of first and second oblique supports, where the first and second oblique supports are pivotally engaged to each other, and where each of the first and second oblique supports are pivotally engaged to one of the first and second hubs and one of the first and second feet.

Another feature of the present invention is the provision in a chair for a child, of a pair of third and fourth oblique supports, where the third and fourth oblique supports are pivotally engaged to each other, and where each of the third and fourth oblique supports are pivotally engaged to one of the second and third hubs and one of the second and third feet.

Another feature of the present invention is the provision in a chair for a child, of a pair of fifth and sixth oblique supports, where the fifth and sixth oblique supports are pivotally engaged to each other, and where each of the fifth and sixth oblique supports are pivotally engaged to one of the third and fourth hubs and one of the third and fourth feet.

Another feature of the present invention is the provision in a chair for a child, of a pair of seventh and eighth oblique supports, where the seventh and eighth oblique supports are pivotally engaged to each other, and where each of the seventh and eighth oblique supports are pivotally engaged to one of the fourth and first hubs and one of the fourth and first feet.

Another feature of the present invention is the provision in a chair for a child, of at least one of the first foot, second foot, third foot, and fourth foot including a receptor for the leg and a mechanical lock portion that mechanically locks the foot to the leg.

Another feature of the present invention is the provision in a chair for a child, of at least one of the first foot, second foot, third foot, and fourth foot including first and second mounts, where each of the first and second mounts pivotally engages one oblique support to a foot, and where each of the first and second mounts is one-piece and integral with the receptor.

Another feature of the present invention is the provision in a chair for a child, of at least one of the first foot, second foot, third foot, and fourth foot including a first base portion, where the first base portion is one-piece and integral with the receptor, where the first base portion includes a first undersurface that defines a first plane, and where the first base portion includes a first structure.

Another feature of the present invention is the provision in a chair for a child, of at least one of the first foot, second foot, third foot, and fourth foot including a second base portion, where the second base portion includes a second undersurface that is disposed in the first plane defined by the first undersurface of the first base portion, where the second base portion is opposite of the first base portion, where the second base portion is one-piece and integral with the receptor and first and second mounts, where the second base portion extends between the first and second mounts, where the second base portion extends for less than 180 degrees about the receptor, and where the second base portion includes a second structure.

Another feature of the present invention is the provision in a chair for a child, of at least one of the first foot, second foot, third foot, and fourth foot including the first structure being a shape different from the second structure.

Another feature of the present invention is the provision in a chair for a child, of the first base portion including a first platform section, where the first platform section includes the first undersurface, where the first structure rises integrally from the first platform section, and where the first structure extends integrally from the receptor.

Another feature of the present invention is the provision in a chair for a child, of the first structure including the first undersurface, where the first structure extends integrally from the receptor.

Another feature of the present invention is the provision in a chair for a child, of the second base portion including a second platform section, where the second platform section includes the second undersurface.

Another feature of the present invention is the provision in a chair for a child, of the first structure including a first section 180 degrees opposite from the first mount and a second section 180 degrees opposite from the second mount.

Another feature of the present invention is the provision in a chair for a child, of the first structure including two sections, where the two sections are one of a) identical to each other and 2) mirror images of each other.

Another feature of the present invention is the provision in a chair for a child, of the first structure including a shape of a toe having a claw extending from the toe.

Another feature of the present invention is the provision in a chair for a child, of the first structure including a shape of a webbed foot.

Another feature of the present invention is the provision in a chair for a child, of the first structure including a shape of a hoof.

Another feature of the present invention is the provision in a chair for a child, of the first structure including a shape of a staircase, where the staircase includes circumferentially extending steps.

Another feature of the present invention is the provision in a chair for a child, of the first structure including the shape of a staircase, where the staircase includes a set of co-axial curving steps, where each of the steps includes a curving rise and a curving run.

Another feature of the present invention is the provision in a chair for a child, of the first structure including the first undersurface, where the first structure includes a first intermediate section and a second intermediate section, where the first intermediate section is convex from the first undersurface to the second intermediate section, and where the second intermediate section is concave from the first intermediate section to the receptor.

Another feature of the present invention is the provision in a chair for a child, of the first structure being on said first base portion, wherein the first structure includes a first section, a second section, and a U-shaped junction therebetween, where the first section is convex from the first base portion to the second section, where the second section is convex from the first section to the receptor, and where the second section includes a U-shaped junction with the receptor.

Another feature of the present invention is the provision in a chair for a child, of the first structure being on the first base portion, where the first base portion includes a perimeter, where the receptor includes a top edge, where the first structure extends from the top edge of the receptor to the perimeter of the first base portion, where the first structure includes first and second triangular end walls, where each of the first and second triangular end walls includes first, second, and third edges, where the first edge defines a straight junction with the first base portion, where the second edge defines a straight junction with the receptor, and where the third edge extends from the receptor to the perimeter of the first base portion, where the first structure includes a front surface running from the top edge of the receptor to the perimeter of the first base portion, where the front surface includes a convex surface portion extending from the perimeter of the first base portion, and where the convex surface portion leads into a concave surface portion that leads into the top edge of the receptor.

Another feature of the present invention is the provision in a chair for a child, of the first structure being on said first base portion, where the first base portion includes a perimeter with a corner, where the receptor includes a top edge, where the first structure extends from the top edge of the receptor to the perimeter of the first base portion, where the first structure includes first and second triangular end walls, where the first structure includes a pair of flat outer surfaces running from the top edge of the receptor to the perimeter of the first base portion, where the first structure includes an inner convex surface running from the top edge of the receptor to the corner of the perimeter, where the inner convex surface is between the flat outer surfaces and defines a U-shaped junction therebetweeen, and where the U-shaped junction runs from the top edge of the receptor to the corner of the perimeter.

Another feature of the present invention is the provision in a chair for a child, of the receptor including a top edge, where the first structure includes a trapezoidal wall that extends from the top edge of the receptor to the first undersurface, where the first structure includes first and second convex portions extending from the top edge of the receptor to the first undersurface, and where the trapezoidal wall is between the first and second convex portions.

Another feature of the present invention is the provision in a chair for a child, of the first structure including a generally diamond shaped flat surface portion nestled in a diamond shaped perimeter of convex portions, where the generally diamond shaped flat surface portion forms a top edge portion of the receptor.

Another feature of the present invention is the provision in a chair for a child, of the first structure being on the first base portion, where the first base portion includes a perimeter, where the receptor includes a top edge, where the first structure extends from the top edge of the receptor to the perimeter of the first base portion, where the first structure is conical, and where the first structure is disposed 180 degrees opposite of one of the first and second mounts.

An advantage of the present invention is a child's chair with a twist at little to no extra cost, where the twist is a foot that is molded in a unique form. The present foot costs the same or only minimally more to mold than a conventional foot.

Another advantage of the present invention is that four ordinary and common locations are turned into four aesthetic locations.

Another advantage of the present invention is that the present foot is just as stable as the conventional foot, but vastly more attractive.

Another advantage of the present invention is that the present foot is not ordinary and common.

BRIEF DESCRIPTION OF THE DRAWINGS

FIG. 4A is a perspective view of a foot for the base chair of FIG. 1A.

FIG. 4B is a top view of the foot of FIG. 4A.

FIG. 4C is a right side elevation view of the foot of FIG. 4A.

FIG. 4D is a front elevation view of the foot of FIG. 4A.

FIG. 4E is a left side elevation view of the foot of FIG. 4A.

FIG. 4F is a bottom view of the foot of FIG. 4A.

FIG. 4G is a rear elevation view of the foot of FIG. 4A.

FIG. 8A is a perspective view of a foot for the base chair of FIG. 1A.

FIG. 8B is a top view of the foot of FIG. 8A.

FIG. 8C is a right side elevation view of the foot of FIG. 8A.

FIG. 8D is a front elevation view of the foot of FIG. 8A.

FIG. 8E is a left side elevation view of the foot of FIG. 8A.

FIG. 8F is a bottom view of the foot of FIG. 8A.

FIG. 8G is a rear elevation view of the foot of FIG. 8A.

FIG. 9A is a perspective view of a foot for the base chair of FIG. 1A.

FIG. 9B is a top view of the foot of FIG. 9A.

FIG. 9C is a right side elevation view of the foot of FIG. 9A.

FIG. 9D is a front elevation view of the foot of FIG. 9A.

FIG. 9E is a left side elevation view of the foot of FIG. 9A.

FIG. 9F is a bottom view of the foot of FIG. 9A.

FIG. 9G is a rear elevation view of the foot of FIG. 9A.

FIG. 11A is a perspective view of a foot for the base chair of FIG. 1A.

FIG. 11B is a top view of the foot of FIG. 11A.

FIG. 11C is a right side elevation view of the foot of FIG. 11A.

FIG. 11D is a front elevation view of the foot of FIG. 11A.

FIG. 11E is a left side elevation view of the foot of FIG. 11A.

FIG. 11F is a bottom view of the foot of FIG. 11A.

FIG. 11G is a rear elevation view of the foot of FIG. 11A.

FIG. 13A is a perspective view of a foot for the base chair of FIG. 1A.

FIG. 13B is a top view of the foot of FIG. 13A.

FIG. 13C is a right side elevation view of the foot of FIG. 13A.

FIG. 13D is a front elevation view of the foot of FIG. 13A.

FIG. 13E is a left side elevation view of the foot of FIG. 13A.

FIG. 13F is a bottom view of the foot of FIG. 13A.

FIG. 13G is a rear elevation view of the foot of FIG. 13A.

FIG. 14A is a perspective view of a foot for the base chair of FIG. 1A.

FIG. 14B is a top view of the foot of FIG. 14A.

FIG. 14C is a right side elevation view of the foot of FIG. 14A.

FIG. 14D is a front elevation view of the foot of FIG. 14A.

FIG. 14E is a left side elevation view of the foot of FIG. 14A.

FIG. 14F is a bottom view of the foot of FIG. 14A.

FIG. 14G is a rear elevation view of the foot of FIG. 14A.

FIG. 16A is a perspective view of a foot for the base chair of FIG. 1A.

FIG. 16B is a top view of the foot of FIG. 16A.

FIG. 16C is a right side elevation view of the foot of FIG. 16A.

FIG. 16D is a front elevation view of the foot of FIG. 16A.

FIG. 16E is a left side elevation view of the foot of FIG. 16A.

FIG. 16F is a bottom view of the foot of FIG. 16A.

FIG. 16G is a rear elevation view of the foot of FIG. 16A.

DESCRIPTION

Figure 1A:
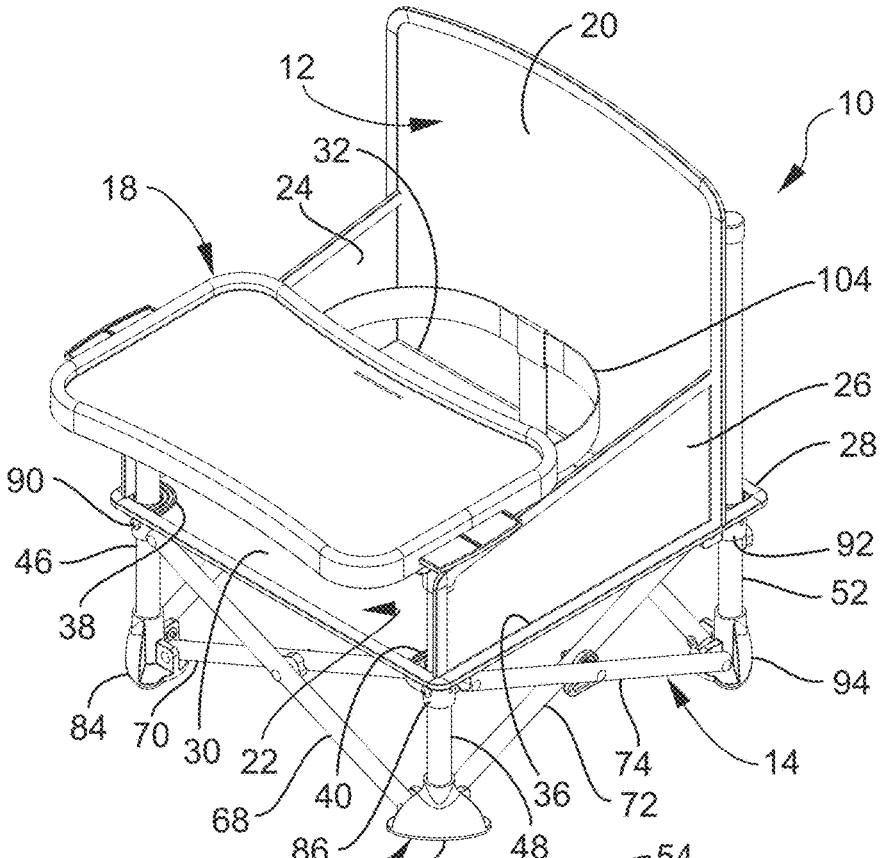
FIG. 1A is a perspective front view of the base chair of the present invention.
Figure 1B:
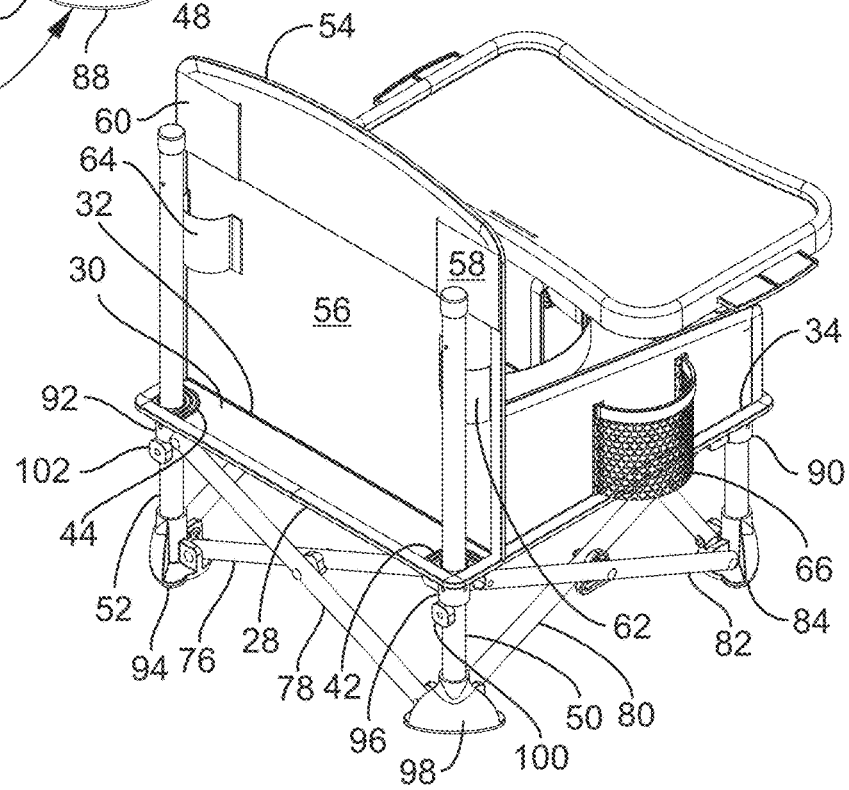
FIG. 1B is a perspective rear view of the base chair of FIG. 1A.

As shown in FIG. 1, reference number 10 indicates the base chair of the present invention. Base chair 10 includes a flexible fabric body receptacle 12, a scissored straight leg and oblique support apparatus 14, feet 16, and a tray 18. The chair 10 has an open form, as shown in FIGS. 1A and 1B, and a folded form that is obtained after the scissored straight leg and oblique support apparatus 14 has been folded.

The flexible fabric body receptacle 12 includes a back 20, a seat 22, a right side arm portion 24, and a left side arm portion 26. The seat 22 includes a flexible perimeter border 28 and a flexible seat portion 30 where the periphery of the flexible seat portion 30 is engaged to the flexible perimeter border 28. The back 20 is engaged to the seat 22 along a lateral and horizontal seam or junction 32 at a location spaced from the rear edge of the flexible perimeter border 28. The right side arm portion 24 is engaged to the seat 22 along a longitudinal and horizontal junction 34 at the right edge of the flexible perimeter border 28. The left side arm portion 26 is engaged to the seat 22 along a longitudinal and horizontal junction 36 at the left edge of the flexible perimeter border 28. The seat 22 includes four corner post cut-outs 38, 40, 42, 44. Cut-out 38 is a right front cut-out for passage of a right front leg 46. Cut-out 40 is a left front cut-out for passage of a left front leg 48. Cut-out 42 is a right rear cut-out for passage of a right rear leg 50. Cut-out 42 is a left rear cut-out for passage of a left rear leg 52. Legs 46, 48, 50, 52 are legs of the scissored straight leg and oblique support apparatus 14.

Back 20 includes a flexible perimeter border 54 and a flexible back portion 56 where three-quarters of the periphery of the flexible back portion 56 are engaged to the flexible perimeter border 54. The one-quarter edge where the flexible perimeter border 54 is not present is at the junction 32. Back 20 includes a pair of pockets 58, 60 for the upper ends of legs 50, 52, respectively. Each of the pockets 58, 60 is open at the bottom and stitched closed at the top such that the upper end of the legs 50, 52 feeds into its respective pocket 58, 60 at a bottom opening. Each of the pockets 58, 60 is formed by stitching a one-piece rectangular sheet of fabric to the rear face of the back 20, where no stitching is made along the lower edge so as to form the open bottom, but where stitching is made along the other three edges to form the pockets 58, 60. Back includes a pair of loops 62, 64 to further engage legs 50, 52, respectively. Each of the loops 62, 64 is formed by a strip of flexible fabric stitched at two ends to the rear face of back 20 so as to form upper and lower openings through which legs 50, 52 pass. Pockets 58, 60 are formed at a higher altitude than loops 62, 64. Each of pockets 58, 60 and loops 62, 64 has an outer edge engaged at the back border 54. Back 20 is at a right angle to seat 22. Junction 32 is disposed forwardly of cut-outs 42, 44.

Right arm portion 24 of fabric body receptacle 12 is a quadrilateral or trapezoidal piece of fabric with an oblique upper edge. A rear edge of right arm portion 24 is vertical and engaged to back 20 at border 54. A lower edge of right arm portion 24 is horizontal and longitudinal and engaged to seat 22 at junction 34. An upper, front and inner corner portion of right arm portion 24 includes a fabric loop, in the nature of loops 62, 64, to engage an upper end portion of leg 46.

Engaged to the right arm portion 24 is a mesh pocket 66 formed of a piece of mesh. Mesh pocket 66 has a closed bottom and an open top. Mesh pocket 66 has two vertical edges that are stitched to the right arm portion 24 and a lower edge that is stitched to the right arm portion 24 at or adjacent to the junction 34. The two vertical edges of the mesh pocket 66 are stitched to two respective locations on the right arm portion 24. Such two respective locations are spaced apart by a first distance that is less than the distance between such two vertical edges prior to when the mesh pocket 66 is stitched to the right arm portion 24 and when the mesh pocket 66 is laid out flat on a surface.

Left arm portion 26 of fabric body receptacle 12 is a quadrilateral or trapezoidal piece of fabric with an oblique upper edge. A rear edge of left arm portion 26 is vertical and engaged to back 20 at border 54. A lower edge of left arm portion 26 is horizontal and longitudinal and engaged to seat 22 at junction 36. An upper, front and inner corner portion of left arm portion 26 includes a fabric loop, in the nature of loops 62, 64, to engage an upper end portion of leg 48.

Scissored straight leg and oblique support apparatus 14 includes upright legs 46, 48, 50, 52 and further includes oblique legs or oblique supports 68, 70, 72, 74, 76, 78, 80, 82. Oblique supports 68, 70 make up a front pivoting pair. Oblique supports 72, 74 make up a left hand side pivoting pair. Oblique supports 76, 78 make up a rear pivoting pair. Oblique supports 80, 82 make up a right hand side pivoting pair.

On the front of chair 10, support 68 is pivotally engaged to foot or lower right front hub 84 and extends obliquely to pivotally engage upper left front hub 86. Support 70 is pivotally engaged to foot or lower left front hub 88 and extends obliquely to pivotally engage upper right front hub 90. Support 68 passes outwardly of and is pivotally engaged to support 70 intermediate the ends of the supports 68, 70.

On the left side of chair 10, support 72 is pivotally engaged to foot or lower left front hub 88 and extends obliquely to pivotally engage upper left rear hub 92. Support 74 is pivotally engaged to foot or lower left rear hub 94 and extends obliquely to pivotally engage upper left front hub 86. Support 74 passes outwardly of and is pivotally engaged to support 72 intermediate the ends of the supports 72, 74.

On the rear of chair 10, support 76 is pivotally engaged to foot or lower left rear hub 94 and extends obliquely to pivotally engage upper right rear hub 96. Support 78 is pivotally engaged to foot or lower right rear hub 98 and extends obliquely to pivotally engage upper left rear hub 92. Support 78 passes outwardly of and is pivotally engaged to support 76 intermediate the ends of the supports 76, 78.

On the right side of chair 10, support 80 is pivotally engaged to foot or lower right rear hub 98 and extends obliquely to pivotally engage upper right front hub 90. Support 82 is pivotally engaged to foot or lower right front hub 84 and extends obliquely to pivotally engage upper right rear hub 96. Support 82 passes outwardly of and is pivotally engaged to support 80 intermediate the ends of the supports 80, 82.

Feet portion 16 of chair 10 includes feet or lower hubs 84, 88, 94 and 98. Each of the lower hubs 84, 88, 94, 98 is a foot.

Upper hubs 86, 90, 92, and 96 are slideable vertically on their respective legs 48, 46, 52, and 50. Rear legs 50, 52 include respective rearwardly projecting stops 100, 102 to set the height at which seat 22 operates as a seat. Each of the rear hubs 92, 96 includes a locking tab that locks into respective legs 52, 50 when the chair 10 is completely open and when rear hubs 92, 96 are adjacent their respective stops 102, 100. The chair 10 is collapsed from the operating form by pushing the tabs inwardly while pushing the lower ends of legs 50, 52 toward each other.

Chair 10 includes tray 18. Tray 18 is engaged to upper end portions of the front legs 46, 48. One end of tray 18 is adjacent to right arm portion 24 of body receptacle 12. The other end of tray 18 is adjacent to left arm portion 26 of body receptacle 12.

Chair 10 includes child restraint strap 104 that includes a horizontal section with two ends that are coupled to each other near the child's tummy. Strap 104 includes a vertical section that is anchored to back 20 such as by stitching. Such vertical section includes an upper loop through which the horizontal section slides.

Figure 2A:
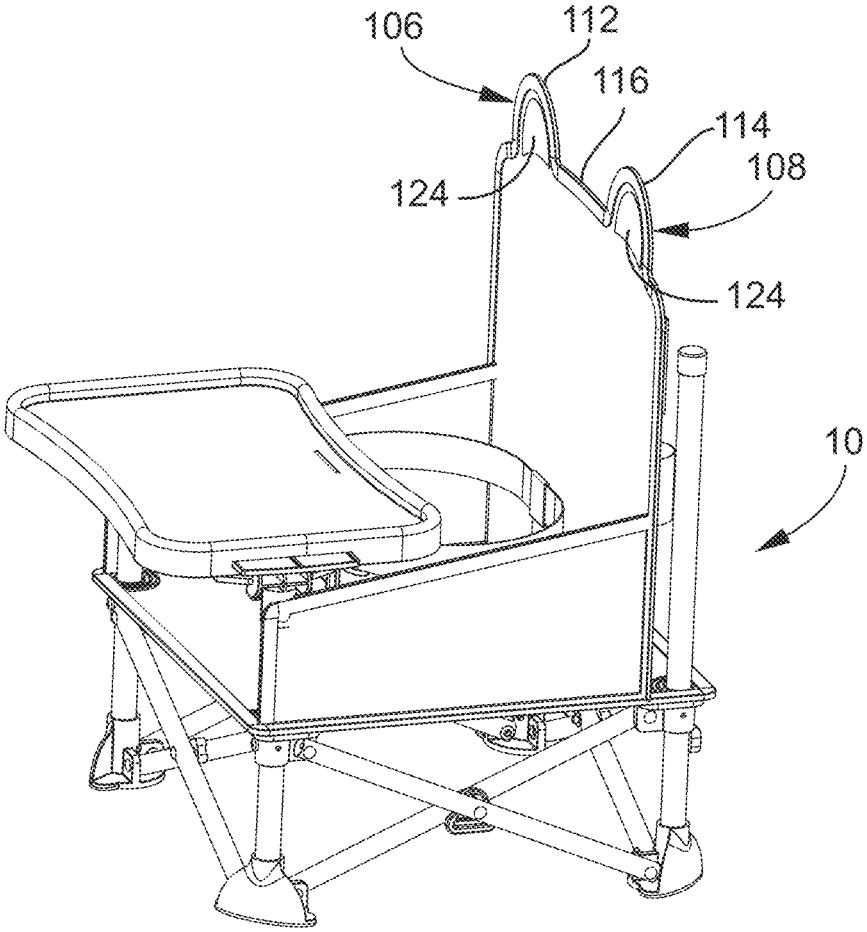
FIG. 2A is a perspective front view of the base chair of FIG. 1A having ears in the nature of animal ears.
Figure 2B:
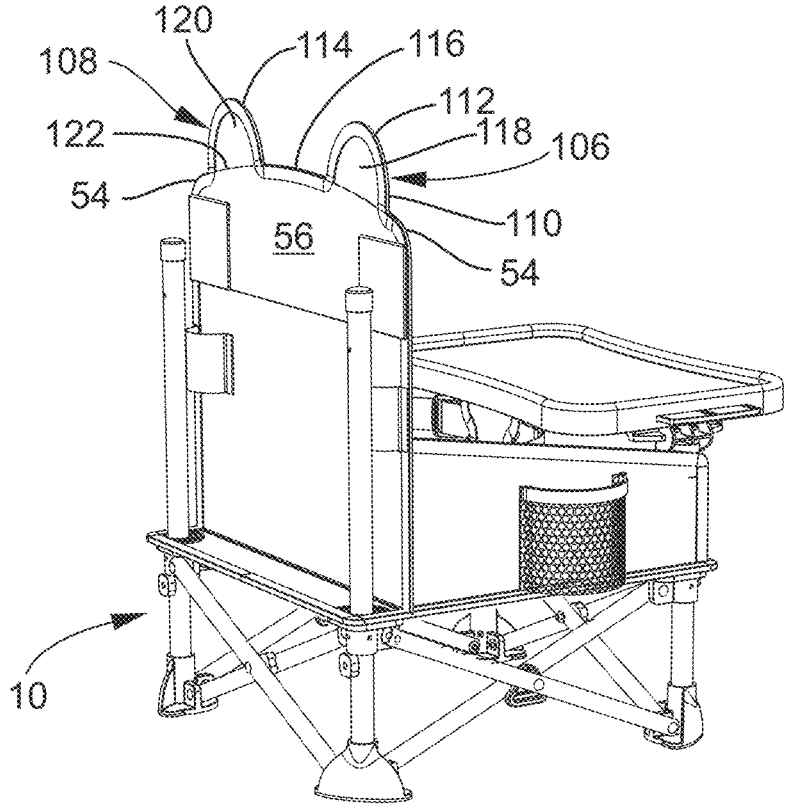
FIG. 2B is a perspective rear view of the chair of FIG. 2A.

As shown in FIG. 2A, chair 10 can include a pair of flexible fabric ears 106, 108 in the nature of animal ears. Chair 10 includes an undulating upper border 110 that runs from the right upper corner portion of back 20 to the left upper corner portion of back 20. Undulating border 110 includes a first inverted U-shaped portion 112 and a second inverted U-shaped portion 114. First inverted U-shaped portion 112 forms the border of ear 106. Second inverted U-shaped portion 114 forms the border of ear 108. Extending between the U-shaped portions 112, 114, is an intermediate border portion 116 that is slightly curved so as to rise upwardly slightly between the ears 106, 108. The outer border sections of the U-shaped border portions 112, 114 lead into corner curved sections of the border 54.

The inverted U-shaped border portions 112, 114 engage fabric flexible pieces 118, 120 that may or may not be integral and one-piece with the fabric of back portion 56. Ear 106 includes a fabric flexible piece 118 that is integral and one-piece with the fabric of back portion 56. Ear 108 includes a fabric flexible piece 120 that is engaged, such as by stitching, to an upper edge 122 of the fabric of back portion 56. As shown in FIG. 2A, the front of ears 106, 108 may have an inked image 124 within the inverted U-shaped border portions 112, 114.

Figure 3A:
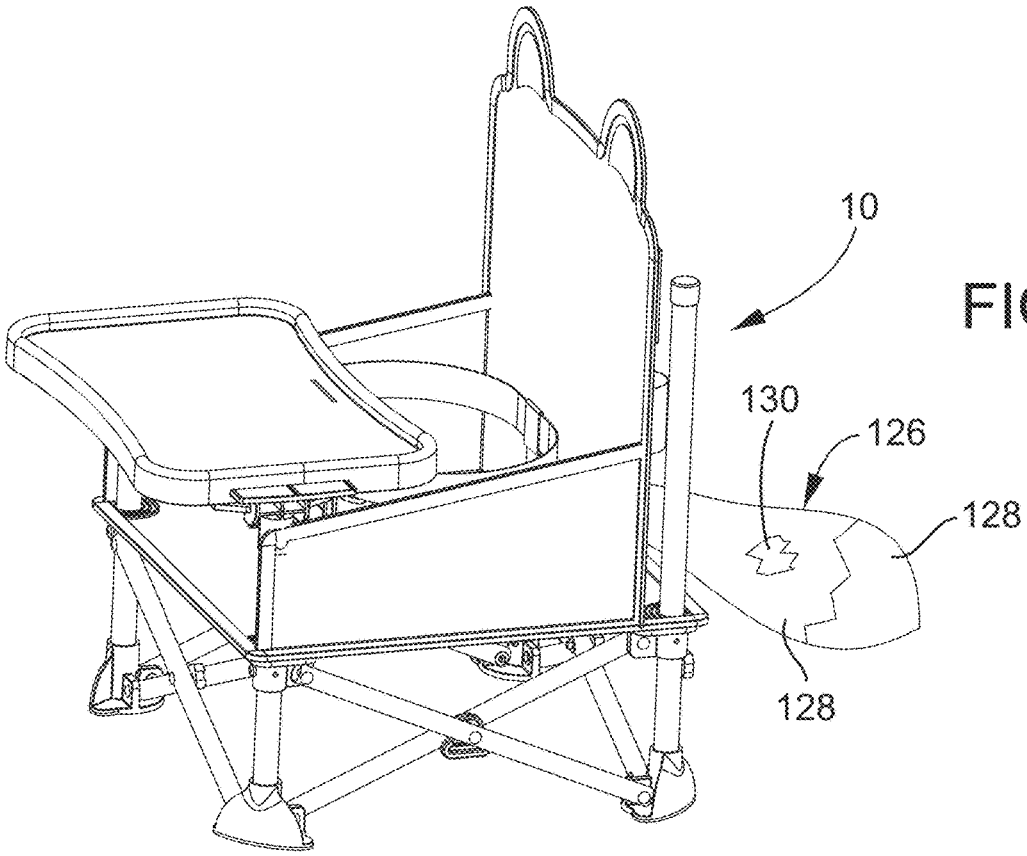
FIG. 3A is a perspective front view of the base chair of FIG. 1A having ears and a tail in the nature of animal ears and an animal tail.
Figure 3B:
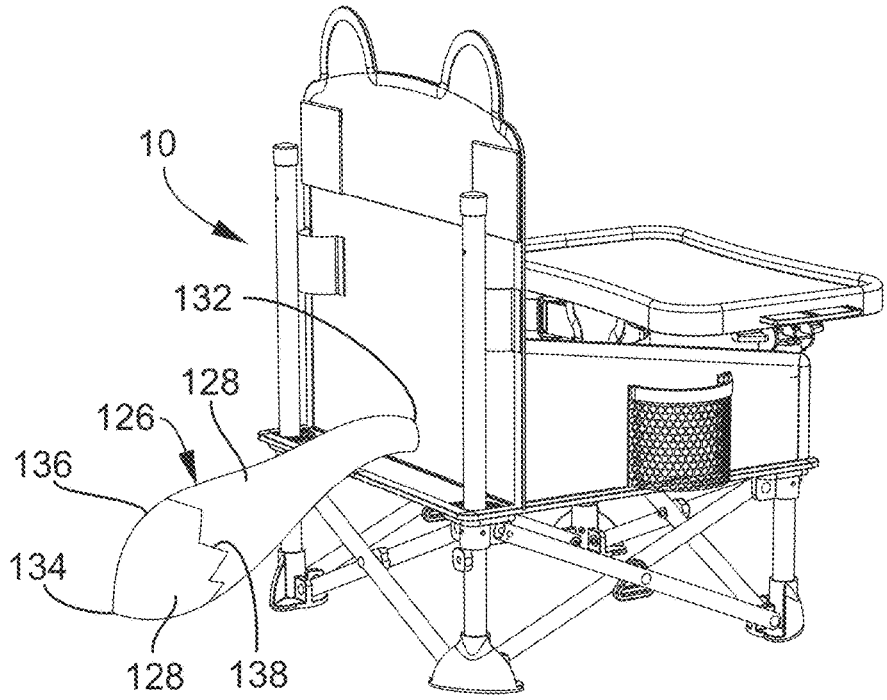
FIG. 3B is a perspective rear view of the chair of FIG. 3A.
Figure 5A:
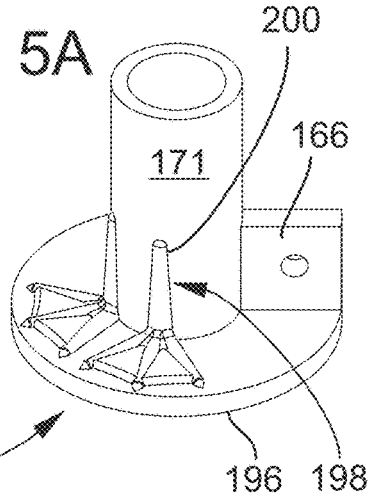
FIG. 5A is a perspective view of a foot for the base chair of FIG. 1A.
Figure 5B:
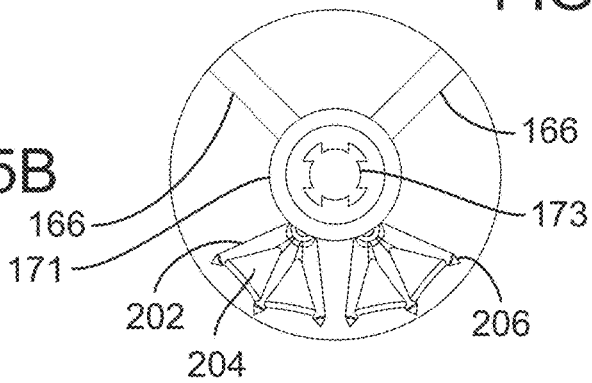
FIG. 5B is a top view of the foot of FIG. 5A.
Figure 5C:
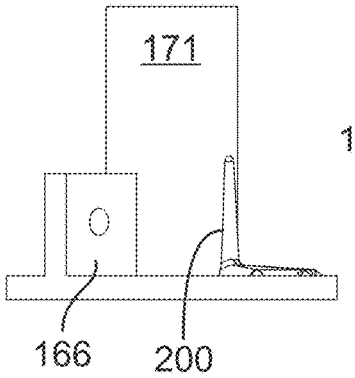
FIG. 5C is a right side elevation view of the foot of FIG. 5A.
Figure 5D:
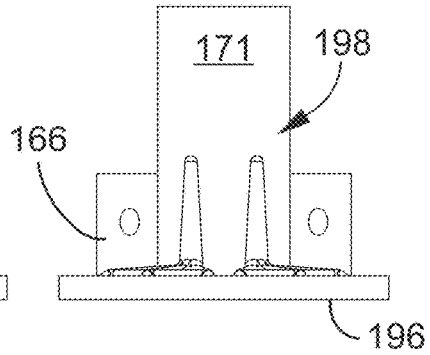
FIG. 5D is a front elevation view of the foot of FIG. 5A.
Figure 5E:
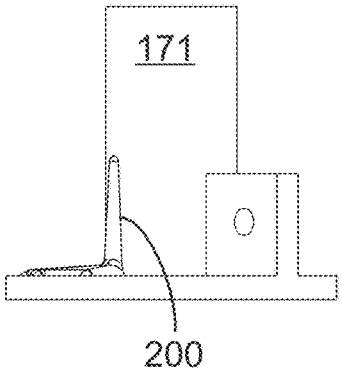
FIG. 5E is a left side elevation view of the foot of FIG. 5A.
Figure 5F:
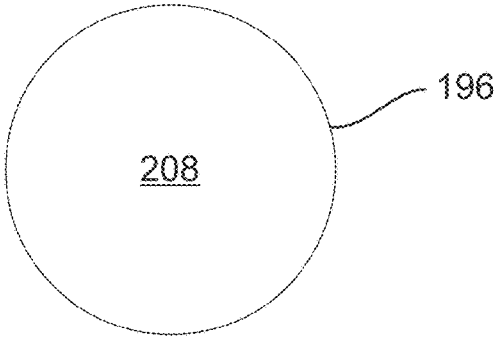
FIG. 5F is a bottom view of the foot of FIG. 5A.
Figure 5G:
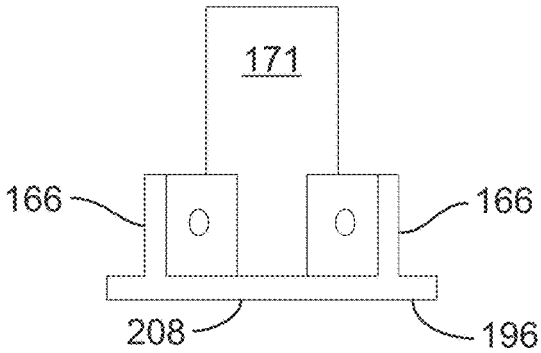
FIG. 5G is a rear elevation view of the foot of FIG. 5A.
Figure 6A:
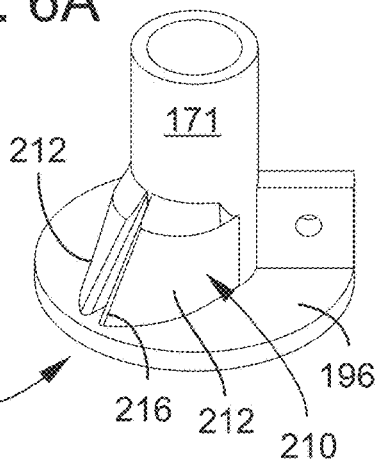
FIG. 6A is a perspective view of a foot for the base chair of FIG. 1A.
Figure 6B:
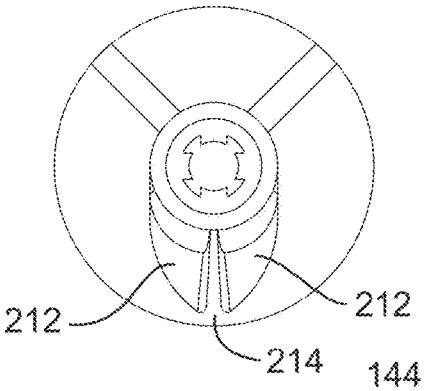
FIG. 6B is a top view of the foot of FIG. 6A.
Figure 6C:
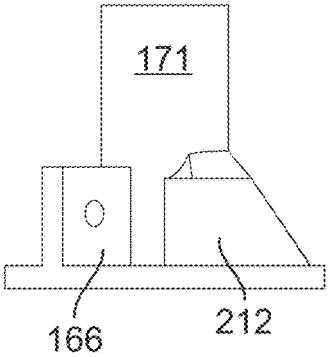
FIG. 6C is a right side elevation view of the foot of FIG. 6A.
Figure 6D:
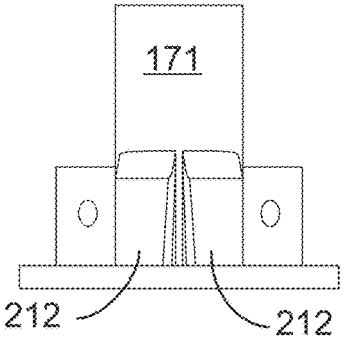
FIG. 6D is a front elevation view of the foot of FIG. 6A.
Figure 6E:
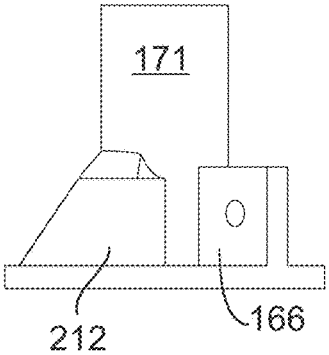
FIG. 6E is a left side elevation view of the foot of FIG. 6A.
Figure 6F:
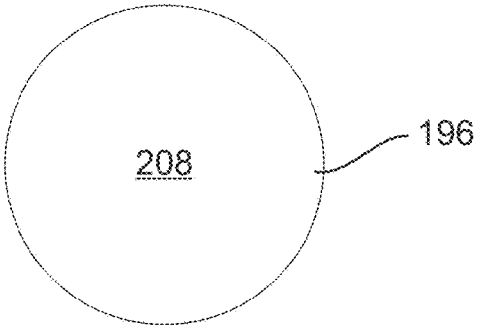
FIG. 6F is a bottom view of the foot of FIG. 6A.
Figure 6G:
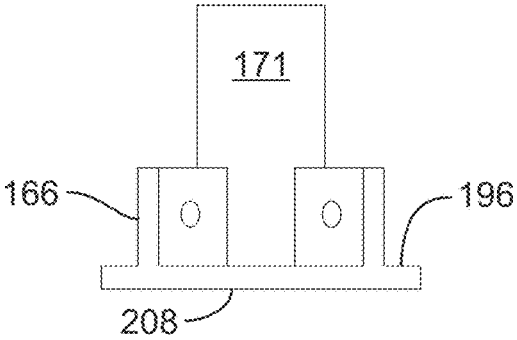
FIG. 6G is a rear elevation view of the foot of FIG. 6A.
Figure 7A:
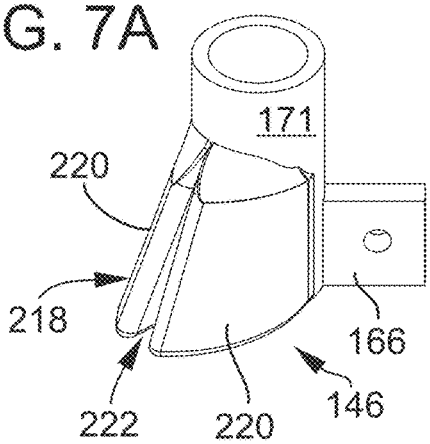
FIG. 7A is a perspective view of a foot for the base chair of FIG. 1A.
Figure 7B:
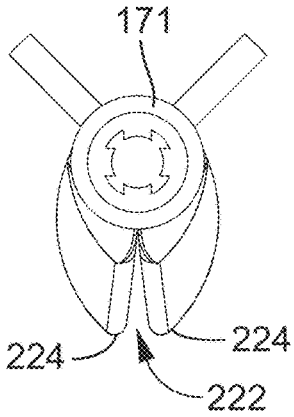
FIG. 7B is a top view of the foot of FIG. 7A.
Figure 7C:
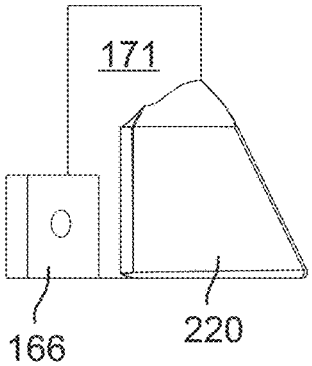
FIG. 7C is a right side elevation view of the foot of FIG. 7A.
Figure 7D:
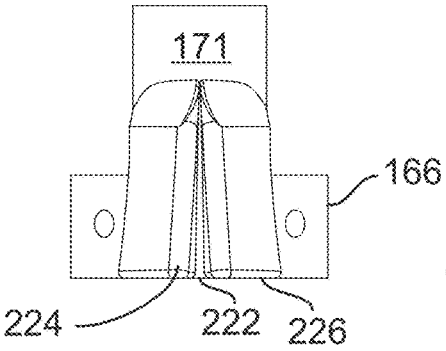
FIG. 7D is a front elevation view of the foot of FIG. 7A.
Figure 7E:
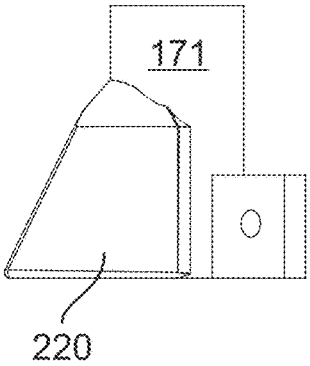
FIG. 7E is a left side elevation view of the foot of FIG. 7A.
Figure 7F:
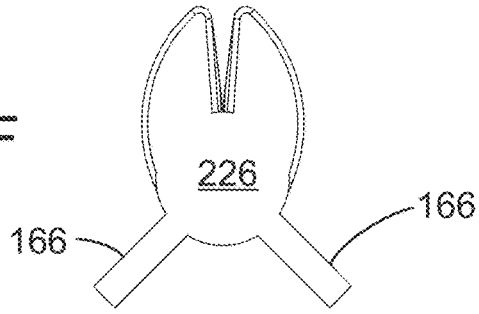
FIG. 7F is a bottom view of the foot of FIG. 7A.
Figure 7G:
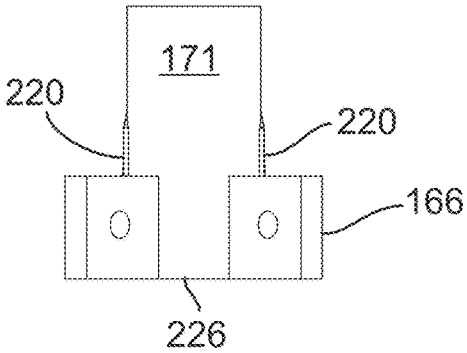
FIG. 7G is a rear elevation view of the foot of FIG. 7A.
Figure 10A:
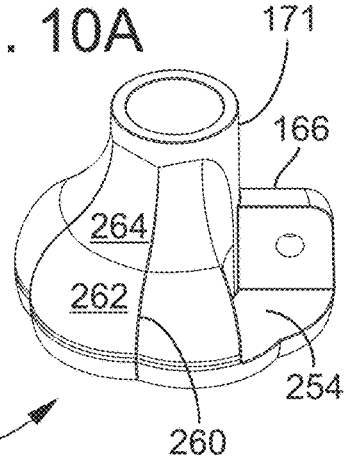
FIG. 10A is a perspective view of a foot for the base chair of FIG. 1A.
Figure 10B:
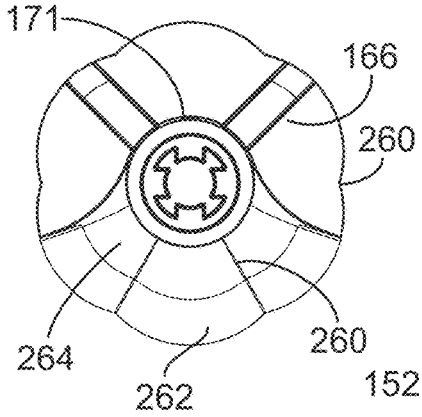
FIG. 10B is a top view of the foot of FIG. 10A.
Figure 10C:
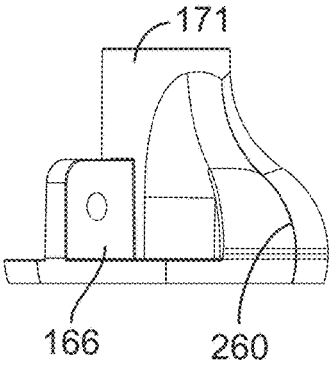
FIG. 10C is a right side elevation view of the foot of FIG. 10A.
Figure 10D:
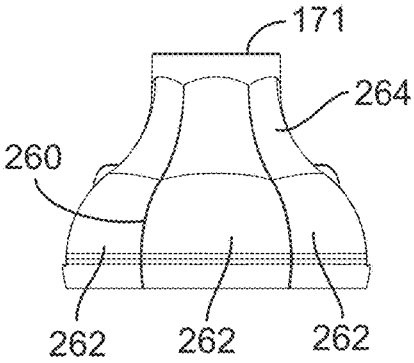
FIG. 10D is a front elevation view of the foot of FIG. 10A.
Figure 10E:
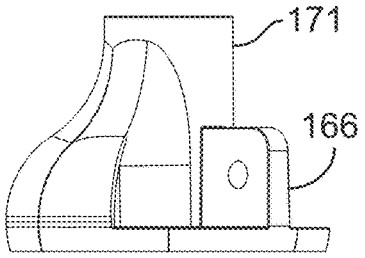
FIG. 10E is a left side elevation view of the foot of FIG. 10A.
Figure 10F:
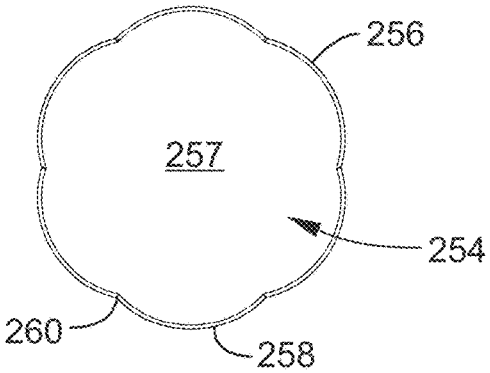
FIG. 10F is a bottom view of the foot of FIG. 10A.
Figure 10G:
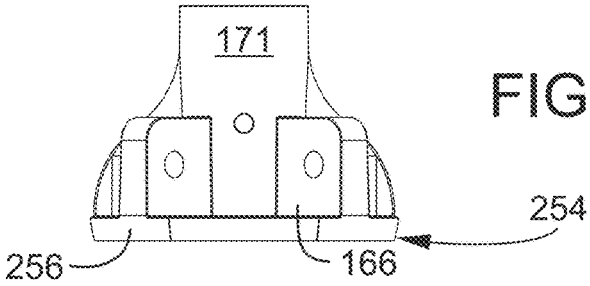
FIG. 10G is a rear elevation view of the foot of FIG. 10A.
Figure 12A:
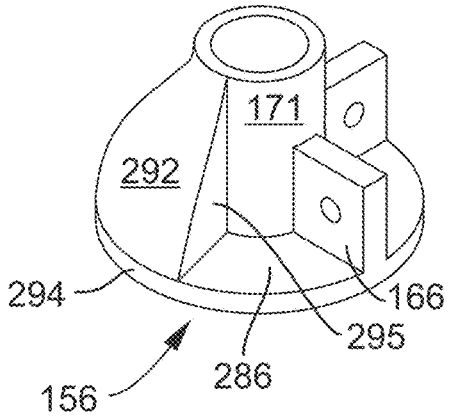
FIG. 12A is a perspective view of a foot for the base chair of FIG. 1A.
Figure 12B:
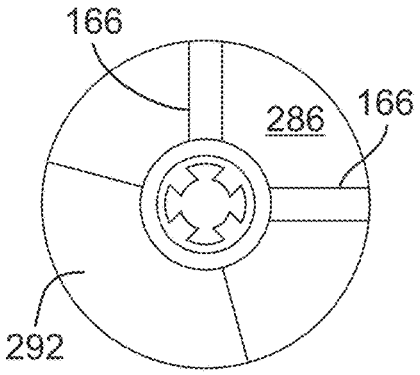
FIG. 12B is a top view of the foot of FIG. 12A.
Figure 12C:
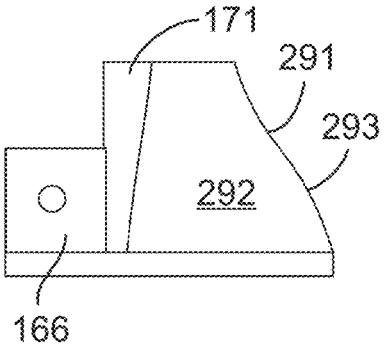
FIG. 12C is a right side elevation view of the foot of FIG. 12A.
Figure 12D:
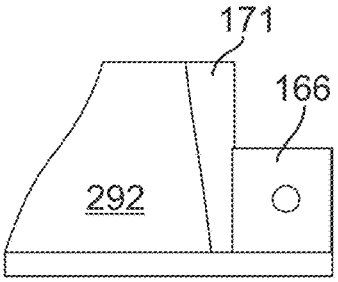
FIG. 12D is a front elevation view of the foot of FIG. 12A.
Figure 12E:
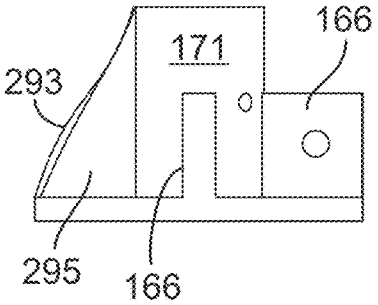
FIG. 12E is a left side elevation view of the foot of FIG. 12A.
Figure 12F:
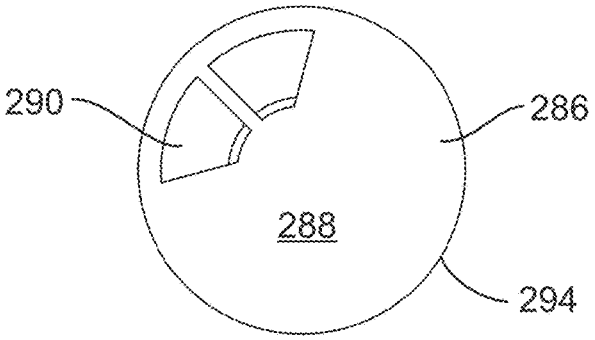
FIG. 12F is a bottom view of the foot of FIG. 12A.
Figure 12G:
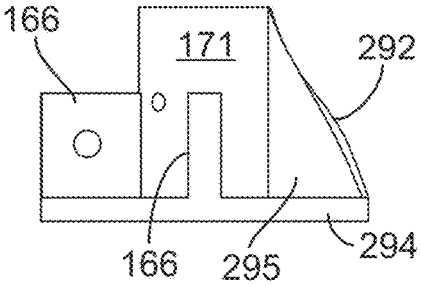
FIG. 12G is a rear elevation view of the foot of FIG. 12A.

FIGS. 3A, 3B show that chair 10 can have a tail 126 in the nature of an animal tail. Tail 126 is three dimensional such that the tail 126 includes a flexible fabric outer skin 128 and a filler 130. Filler 130 provides a three dimensional effect and may include one or more of stuffing materials such as synthetic fiber batting, cotton, straw, wood wool, plastic pellets, beans, poly beads, plastic pellets, polyester fill, cotton batting, cotton balls, newspaper, pebbles, rice, polyester stuffing, scrap polyester stuffing, shredded foam stuffing, shredded memory foam stuffing, shredded latex stuffing, cotton stuffing, and wool stuffing. The flexible fabric outer skin 128 may be velvet or felt or another soft flexible fabric. Tail 126 includes a proximal end 132 and a distal end 134. The tail proximal end 132 is affixed, such as by stitching, to a lower rear portion of the back portion 56. Tail 126 has a greatest width at portion 136, where portion 136 is closer to the distal end 134 than the proximal end 132. The skin 128 of tail 126 can have two different colors separated by a toothed or jagged line 138. Lateral sections of tail 126, when the tail 126 is stuffed and taken anywhere from the proximal end 132 to the distal end 134, have circular skin perimeters.

FIGS. 4A, 5A, 6A, 7A, 8A, 9A, 10A, 11A, 12A, 13A, 14A, 15A, and 16A show, respectively, feet 140, 142, 144, 146, 148, 150, 152, 154, 156, 158, 160, 162, and 164. Any of such feet shown in FIGS. 4A through 16A can be any of right front foot 84, left front foot 88, left rear foot 94, and right rear foot 98. Any of such feet shown in FIGS. 4A through 16A can be engaged to oblique support pair 70, 82 or oblique support pair 68, 72, or oblique support pair 74, 76 or oblique support pair 78, 80.

Each of the feet shown in FIGS. 4A through 16A includes a pair of mounting platforms or mounts 166 disposed relative to each other at a right angle. Each of the mounts 166 has a through hole 168 for engaging a pin connector to pivotally mount one of the oblique supports 68, 70, 72, 74, 76, 78, 80, 82. Mount 166 is a plate section having opposing faces 170 that are parallel to each other, with through hole 168 extending through the opposing faces 170.

Each of the feet shown in FIGS. 4A through 16A includes a cylindrical receptor 171 for receiving one of the straight legs 46, 48, 50, 52. Cylindrical receptor 171 can mechanically lock such leg or adhesively secure such leg therein or the connection between such leg and the cylindrical receptor 171 can be a friction fit. Such leg may be removably engaged to the cylindrical receptor 171 such as by a mechanical key lock 173 having four radially extending dovetail portions, where a bottom portion of one of the straight legs includes a complementary structure that can be inserted into lock 173 and then turned so as to lock the straight leg to the foot. Mechanical key lock 173 can be at the bottom portion of the cylindrical receptor 171. Mounts 166 extend radially from the cylindrical receptor 171. Cylindrical receptor 171 is a tube that is one-piece and integral with the mounts 166.

Each of the feet shown in FIGS. 4A through 16A has a bottom face 172. Bottom face 172 defines a plane that is set at a right angle to the axis of cylindrical receptor 171. Each of the faces 170 of mount 166 defines a plane that is set at a right angle to the plane defined by bottom face 172 or planar surface 186.

As shown in FIGS. 4A through 4G, foot or paw 140 includes a foot base 174 that includes a set of five toes 176 where each of the toes 176 includes a single claw 178. Foot base 174 includes a pair of downwardly tapering portions 180, where each portion 180 extends downwardly from one mount 166 and is also integral with and connected to the cylindrical receptor 171. Two toes 176 extend integrally downwardly from each of the downwardly tapering portions 180. The middle toe 176 extends downwardly from the cylindrical receptor 171. The sides of adjacent toes 176 are integral and connected to each other. The undersides of claws 178 are coplanar with the planar surface 186 that defines a plane. Upper surface of claw 178 defines a curved or round line. Each of the toes 176 has distinct digits as the toe 176 extends from upper portion 180 (or as toe 176 extends from cylindrical receptor 171 in the case of the middle toe 176) to its respective claw 178.

The bottom face 172 that defines a plane are raised (or lowered) toe pads 182 and a raised (or lowered) heel pad 184. The raised (or lowered) toe pads 182 and raised (or lowered) heel pad 184 are raised (or lowered) relative to a planar surface 186. Preferably, planar surface 186 has a greater altitude, and is set at a greater height, when foot 140 is upright, than are toe pads 182 and heel pad 184 such that when set upon a surface such as dirt or clay, the toe and heel pads 182, 184 leave imprints in the dirt or clay. Toe pads 182 are elliptical shaped or oval shaped. Heel pad 184 is bean shaped. The perimeter of planar surface 186 includes first and second curved or convex line portions 188 that merge into each other at a convex line portion 190. At the distal ends of the convex lines 188, the perimeter includes U-shaped line portions 192 defining the toes 176. U-shaped line portions 192 are interrupted by U-shaped line portions 194 defining the claws 178.

As shown in FIGS. 5A through 5G, foot 142 includes cylindrical receptor 171, mounts 166, and key lock 173. Foot 142 further includes an integral disk shaped or cylindrically shaped base or platform 196. Cylindrical receptor 171 and mount 166 extend integrally upwardly from, and are set at a right angle to, disk shaped base or platform 196.

Foot 142 further includes a set of two feet 198, where each foot 198 includes a metatarsus portion 200, three toes 202, two interdigital webs 204 and three claws 206. The feet 198 are integral with the base 196 and the cylindrical receptor 171. The metatarsus portion 200 extends from the cylindrical receptor 171. The toes 202, web 204, and claws 206 extend upwardly from the base 196. Web 204 extends between two adjacent toes 202. The middle claw 206 is adjacent to the perimeter of the base 196. All claws 206 are within the perimeter of the base 196. Disk base or platform 196 includes a flat smooth planar bottom surface 208.

As shown in FIGS. 6A through 6G, foot 144 includes cylindrical receptor 171, mounts 166, and key lock 173. Foot 144 further includes the integral disk shaped or cylindrically shaped base or platform 196 with the smooth planar bottom surface 208. Cylindrical receptor 171 and mount 166 extend integrally upwardly from, and are set at a right angle to, disk shaped base or platform 196.

Ruminant foot 144 further includes a ruminant foot portion 210 extending forwardly from the cylindrical receptor 171 and upwardly from the base 196. Ruminant foot portion 210 includes two hooves 212 and a cleft 214 between the hooves 212. Cleft 214 is an opening that extends to the cylindrical receptor 171 and separates the hooves 212. Each of the hoofs 212 includes a toe portion 216 that is adjacent to and within the perimeter of the base 196.

As shown in FIGS. 7A through 7G, foot 146 includes cylindrical receptor 171, mounts 166, and key lock 173.

Ruminant foot 146 further includes a ruminant foot portion 218 extending forwardly from the cylindrical receptor 171. Ruminant foot portion 218 includes two hooves 220 and a cleft 222 between the hooves 220. Cleft 222 is an opening that extends short of the cylindrical receptor 171 at the top of the foot portion 218 and that extends to the cylindrical receptor 171 at the bottom of the foot portion 218. In other words, the inner sides 224 of hooves 220 are joined at the inner top portions and separated at their inner bottom portions. Each of the hooves 220 includes a toe portion 216 that is adjacent to and within the perimeter of the base 196. Cylindrical receptor 171, mounts 166, and hooves 220 share a common bottom flat smooth surface 226. The top of the hooves 220 is set at a greater height than the top of the mounts 166.

As shown in FIGS. 8A through 8G, foot 148 includes cylindrical receptor 171, mounts 166, and key lock 173.

Webbed foot 148 further includes three toes 228, two interdigital webs 230 and three claws 232. Each of the webs 230 includes an inner V-shaped portion 234 and an outer tapered portion 236. Webbed foot 148 further includes a rear web 238 extending between mounts 166. Cylindrical receptor 171, mounts 166, rear web 238, toes 228, webs 230 and claws 232 share a common bottom flat smooth surface 240.

As shown in FIGS. 9A through 9G, foot 150 includes cylindrical receptor 171, mounts 166, and key lock 173.

Staircase foot 150 includes a disk shaped base or platform 242 with a cut-out 244, as shown in FIG. 9F. Disk shaped base or platform 242 includes an annular portion 246 that shares a common bottom surface 248 with an inset portion 250. Inset portion 250 includes the cut-out 244. Staircase foot 150 includes a set of steps 252 that rise from the base 242 to the top of the cylindrical receptor 171. The bottommost step 252 has a greater horizontal length than the topmost step 252, where the bottommost step 252 is on the base 242 and where the topmost step 252 is adjacent to the top of the cylindrical receptor 171. The longer the horizontal length of the step 252, the lower the altitude that such step 252 has. The shorter the horizontal length of the step 252, the greater the altitude that such step 252 has. The closer the step 252 is to the perimeter of base 242, the lower the altitude the step 252 has. The further the step 252 is from the perimeter of the base 242, the higher the altitude such step 252 has. In other words, staircase foot 150 includes steps 252 extending circumferentially about the cylindrical receptor 171, or staircase foot 150 includes a set of steps 252, where each of the steps includes a rise and a run, and where each of the rises and runs are coaxial with each other and with the cylindrical receptor 171.

As shown in FIGS. 10A through 10G, foot 152 includes cylindrical receptor 171, mounts 166, and key lock 173.

Foot 152 further includes a base 254 having a perimeter 256 and a bottom surface or undersurface 257. Perimeter 256 is formed by six convex line portions 258 that come together at hard junctions 260 with no concave line portions therebetween. Opposite of the mounts 166, three bulb portions 262 are formed and are set on base 254. The surfaces of bulbs 262 have a convex shape. Extending upwardly from each of the bulbs 262 is a concave portion 264 that tapers into the cylindrical receptor 171. Hard junctions 260 extend from base 254 to be disposed between adjacent bulb portions 262 and adjacent concave portions 264. Bulb portions 262 are disposed outwardly of concave portions 264. Bulb portions 262 taper into the perimeter 256. In other words, foot 152 includes first lower sections 262 and second upper sections 264, where the first sections 262 are convex from the undersurface 257 to the second sections 264, and where the second sections 264 are concave from the first sections 262 to the cylindrical receptor 171. The set of first sections 262 includes an intermediate section 262 disposed between two outer sections 262. The set of the second sections 264 includes an intermediate section 264 disposed between two outer sections 264.

As shown in FIGS. 11A through 11G, foot 154 includes cylindrical receptor 171, mounts 166, and key lock 173. Foot 154 includes a base 266 having a perimeter 268.

The perimeter 268 includes an oblong line portion 270 and a curved line rear portion 272. The curved line rear portion 272 runs adjacent to the mounts 166. Extending about the cylindrical receptor 171 is a collar 274. Depending from the collar 274 is a cloak 276. Cloak 276 extends to a front portion of the oblong line portion 270 of base 266. Base 266 includes a planar bottom surface 280 with raised indicia 278 such that the raised indicia 278 leaves an imprint on dirt or clay after the foot 154 has been set upright in the dirt or clay. When the foot 154 is in an upright position, the bottom surface of the indicia 278 is at a lower altitude than the planar bottom surface 280. Collar 274 includes an upper U-shaped neck line 282. A junction 284 between the collar 274 and the cloak 276 is also U-shaped. The oblong portion 270 has two opposite ends 285. The cloak 276 extends forwardly of and between the two opposite ends 285. The cloak 276 is convex. The surface of the cloak 276 is smooth. In other words, foot 154 includes a first section 276 and a second section 274, where the first section 276 is convex from the first base portion 266 to the second section 274, where the second section is concave from the first section 276 to the cylindrical receptor 171, and where the first base portion 266 defines a section of an oblong shape.

As shown in FIGS. 12A through 12G, foot 156 includes cylindrical receptor 171, mounts 166, and key lock 173.

Foot 156 further includes an integral disk shaped or cylindrically shaped base or platform 286 with a smooth flat bottom surface 288. Base 286 includes a cut-out 290 that extends into cloak 292. Cylindrical receptor 171 and mount 166 extend integrally upwardly from, and are set at a right angle to, disk shaped base or platform 286. Extending downwardly from the upper edge or top of the cylindrical receptor 171 to a circular perimeter 294 of the base 286 is a cloak 292. Cloak 292 extends generally for 120 degrees about the circular perimeter 294. Cloak 292 extends for generally 120 degrees about the circular top edge of the cylindrical receptor 171. The surface of cloak 292 is smooth. Cloak 292 is on a front portion of the foot 156. Mounts 166 are disposed on a rear portion of the foot 156. Cloak 292 is on a first base portion of the base 286. The first base portion includes the perimeter 294. The receptor 171 includes a top annular edge and the cloak 294 extends from the top edge of the receptor 171 to the perimeter 294 of the first base portion of the base 286. The cloak 292 includes first and second triangular end walls 295. Each of the first and second triangular end walls 295 has first, second, and third edges, with the first edge defining a straight junction with the first base portion of the base 286, with the second edge defining a straight junction with the receptor 171, and with the third edge being straight and extending from the receptor 171 to the perimeter 294 of the first base portion of the base 286. The cloak 292 includes a front surface running from the top annular edge of the receptor 171 to the perimeter 294 of the first base portion of the base 286, where the front surface includes a convex surface portion 293 extending from the perimeter 294 of the first base portion of the base 286, where the convex surface portion 293 leads into a concave surface portion 291 that in turn leads into the top annular edge of the receptor 171.

As shown in FIGS. 13A through 13G, foot 158 includes cylindrical receptor 171, mounts 166, and key lock 173.

Foot 158 further includes an integral square shaped base 296 with a smooth flat bottom surface. Base 296 includes a cut-out 298 that extends into a first structure or bifurcated slide. Base 296 includes a square perimeter 302 with rounded corners. Outer portions 304 of the first structure depend from the top edge of the cylindrical receptor 171 to a straight edge of the square perimeter 302. Outer portions 304 are flat and planar but may be concave if desired. An intermediate or inner portion 306 of the first structure runs from the top edge of the cylindrical receptor 171 to a rounded corner of the square perimeter 302. Inner portion 306 is convex. A junction 308 between the outer and inner portions 304, 306 is U-shaped. A back side 310 of the outer portion 304 is triangular shaped so as to define a triangular end wall 310 that defines a straight junction with the base 296, a straight junction with the cylindrical receptor 171, and a straight junction with outer portion 304. A radius or curved transition 311 is disposed between triangular wall 310 and outer portion 304. First structure extends for more than one-quarter of the square perimeter 302 and less than one-half of the square perimeter 302.

As shown in FIGS. 14A through 14G, foot 160 includes cylindrical receptor 171, mounts 166, and key lock 173.

Foot 160 includes a base 312 having a perimeter 313 defined by a dovetail portion 314 and a rectangular portion 316 having clipped or straight line corners 318. Dovetail portion 314 includes tapered sections 320. Foot 160 includes a trapezoidal front wall 322 extending from a top edge of cylindrical receptor 171 to a bottom face 324 of the base 312. The trapezoidal front wall 322 tapers downwardly and outwardly from the top edge of the cylindrical receptor 171 to the bottom surface 324 of the base 312. The trapezoidal front wall 322 is bounded on either side by ends 326 that are circular or rounded in the horizontal direction from the top edge of the cylindrical receptor 171 to the bottom surface 324 of the base 312. Ends 326 taper outwardly and downwardly from the top edge of the cylindrical receptor 171 to the bottom surface 324 of the base 312. Ends 326 are convex. Base 312 includes cut-outs 328. Trapezoidal front wall 322, convex ends 326, and triangular end walls 327 define a first structure that extends from the top edge of the cylindrical receptor 171 to the undersurface or bottom surface 324 of the base 312.

As shown in FIGS. 15A through 15G, foot 162 includes cylindrical receptor 171, mounts 166, and key lock 173.

Figure 15A:
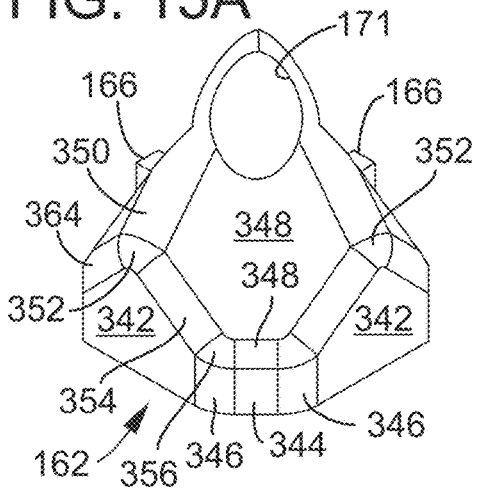
FIG. 15A is a perspective view of a foot for the base chair of FIG. 1A.
Figure 15B:
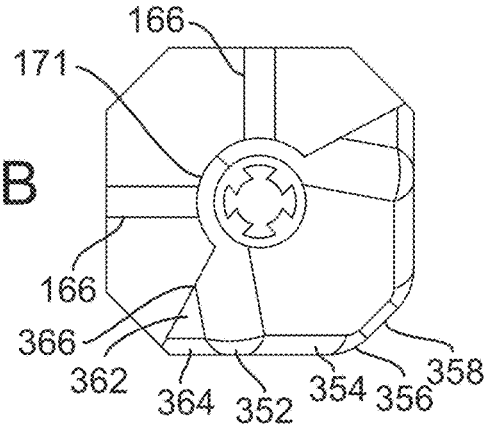
FIG. 15B is a top view of the foot of FIG. 15A.
Figure 15C:
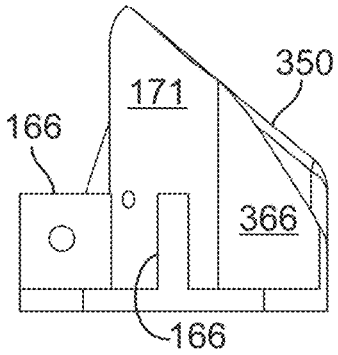
FIG. 15C is a right side elevation view of the foot of FIG. 15A.
Figure 15D:
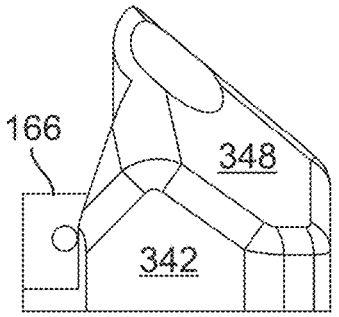
FIG. 15D is a front elevation view of the foot of FIG. 15A.
Figure 15E:
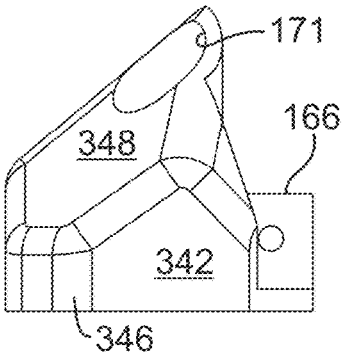
FIG. 15E is a left side elevation view of the foot of FIG. 15A.
Figure 15F:
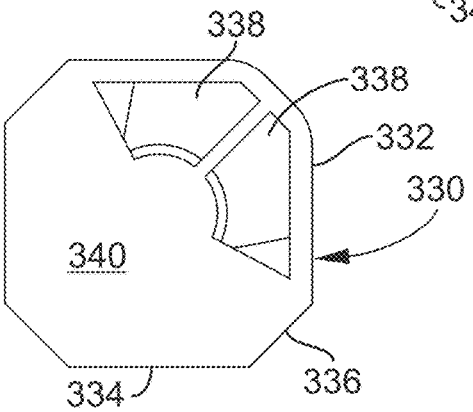
FIG. 15F is a bottom view of the foot of FIG. 15A.
Figure 15G:
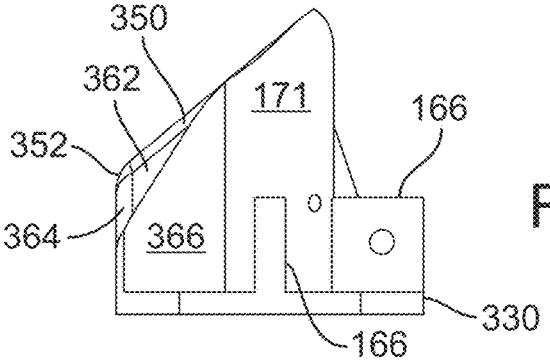
FIG. 15G is a rear elevation view of the foot of FIG. 15A.

Foot 162 includes a base 330 having a perimeter 332 with eight sides that includes four relatively long straight sides 334 and four relatively short straight sides 336. Base 330 includes cut-outs 338. Base 330 includes a bottom planar surface 340. Foot 162 includes a pair of flat outer sidewalls 342 rising vertically upwardly from long straight sides 334. Foot 162 includes a flat inner or front sidewall 344 rising upwardly from a short side 336. A curved transition sidewall 346 is disposed between front wall 344 and outer sidewall 342 and rises from bottom surface 340. Foot 162 includes a front generally diamond shaped oblique flat portion 348. Diamond shaped oblique portion 348 shares a top oval shaped junction with the cylindrical receptor 171. Diamond shaped oblique portion 348 shares a pair of junctions with a pair of curved portions 350 that depend from a rear uppermost portion of the cylindrical receptor 171, extend about the cylindrical receptor 171 and then depend to just short of sidewalls 342, whereupon transitional curved portions 352 lead directly into sidewalls 342. Foot 162 includes a curved transition portion 354 between diamond shaped portion 348 and sidewall 342, a curved transition portion 356 between diamond shaped portion 348 and transition portion 346, and a curved transition portion 358 between diamond shaped portion 348 and front wall 344. Foot 162 includes a curved transition portion 352 between curved portion 350 and sidewall 342. Curved portion 350 leads into a flat portion 362. Foot 162 includes a curved transition portion 364. Foot 162 includes a pair of flat vertically extending portions 366, where each portion 366 shares junctions with cylindrical receptor 171, base 330, curved portion 350, flat portion 362, transition 364, and outer wall 342. Unlike the other feet herein, foot 162 cuts the cylindrical receptor 171 not in a horizontal plane but in an oblique plane such that the opening of the cylindrical receptor, as shown in FIGS. 15A, 15D, and 15E, appears oval in shape. It should be noted that an undulating sequential run of transition portions extends from transition portion 364 to transition portion 352 to transition portion 354 to transition portion 356 to transition portion 348 to transition portion 356 to transition portion 354 to transition portion 352 to transition portion 362. The junctions between the long and short sides 332, 334 are hard or sharp junctions except where transition portions 346 and 344 rise from the bottom surface 340. The flat diamond shaped portion 348 is nested by the diamond shaped sequence of curved or convex portions 350, 352, 354, 356, 348, 356, 354, 352 and 350. The diamond shaped flat surface portion 346 effectively forms a portion of the top edge of the cylindrical receptor 171.

As shown in FIGS. 16A through 16G, foot 164 includes cylindrical receptor 171, mounts 166, and key lock 173. Foot 164 further includes the integral disk shaped or cylindrically shaped base or platform 196. Cylindrical receptor 171 and mount 166 extend integrally upwardly from, and are set at a right angle to, disk shaped base or platform 196. Base or platform 196 includes the smooth flat planar bottom surface 208.

Foot 164 further includes a pair of conical portions 368. Each of the conical portions 368 rise from base 196 to the top annular edge of the cylindrical receptor 171. From a side view, each of the conical portions 368 is truly conical and includes an apex or tip 370. From a view taken directly in front of the conical portion 368, such as the views shown in FIGS. 16C and 16D, the conical portions 368 are frusto-conical, with the cone cut off at location 372. Conical portions 368 have a wider base and a narrower top. Each of the conical portions 368 includes a base that intersects the perimeter of the base 196 at one point so as to be tangential to the base 196. Each of the conical portions 368 includes a base that is spaced from the outside cylindrical surface of the cylindrical receptor 171. A vertical wall 374 connects an inner surface of the conical portion 368 with the cylindrical outer surface of the cylindrical receptor 171. The vertical wall 374 tapers in width as the wall 374 rises from the base 196 to the tip 370. Each of the conical portions 368 is disposed 180 degrees from one of the mounts 166.

Figure 17A:
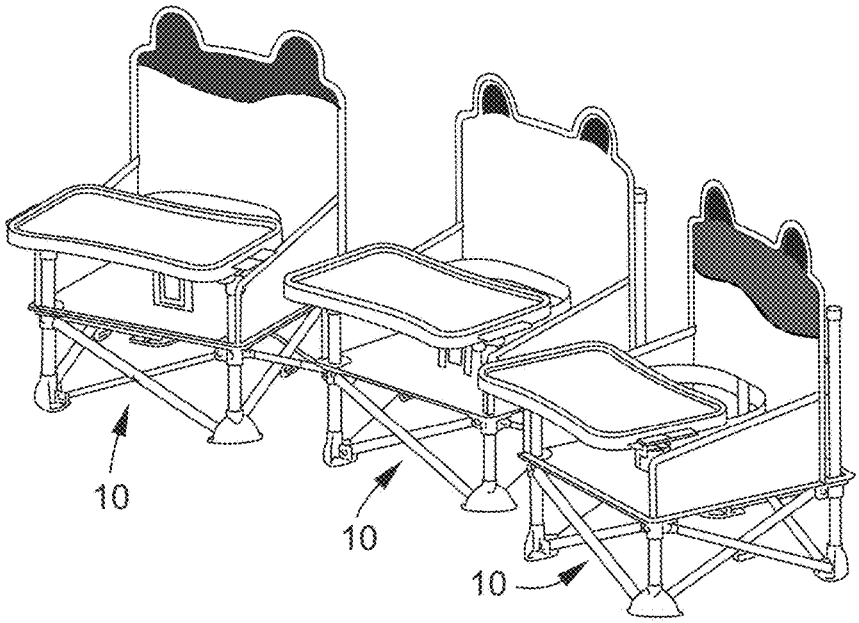
FIG. 17A is a perspective view of a set of three of the chairs of FIGS. 3A and 3B showing that the fabric of the chairs can be colored differently.

FIG. 17A shows a set of three base chairs 10 where the fabric body 12, including the back portion 20, seat portion 22, right side arm 24, and left side arm 26, has a solid color. Each of the chairs 10 of the set of FIG. 17A has a fabric body 12 of a different solid color.

Figure 17B:
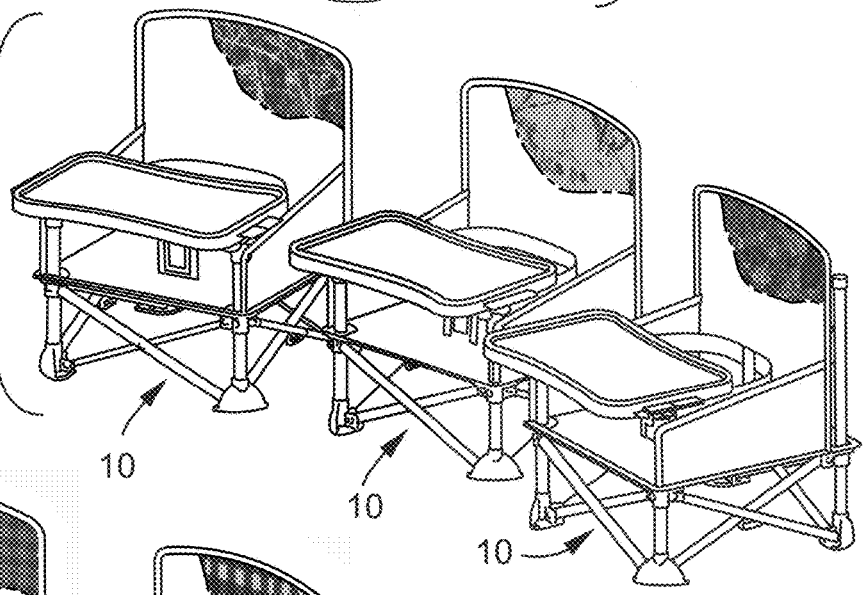
FIG. 17B is a perspective view of a set of three of the base chairs of FIGS. 1A and 1B showing that the fabric of the chairs can have different patterns.

FIG. 17B shows a set of three base chairs 10 where the fabric body 12, including the back portion 20, seat portion 22, right side arm 24, and left side arm 26, has an outdoor nature plant pattern. Each of the chairs 10 of the set of FIG. 17B has a fabric body 12 of a different outdoor nature plant pattern.

Figure 17C:
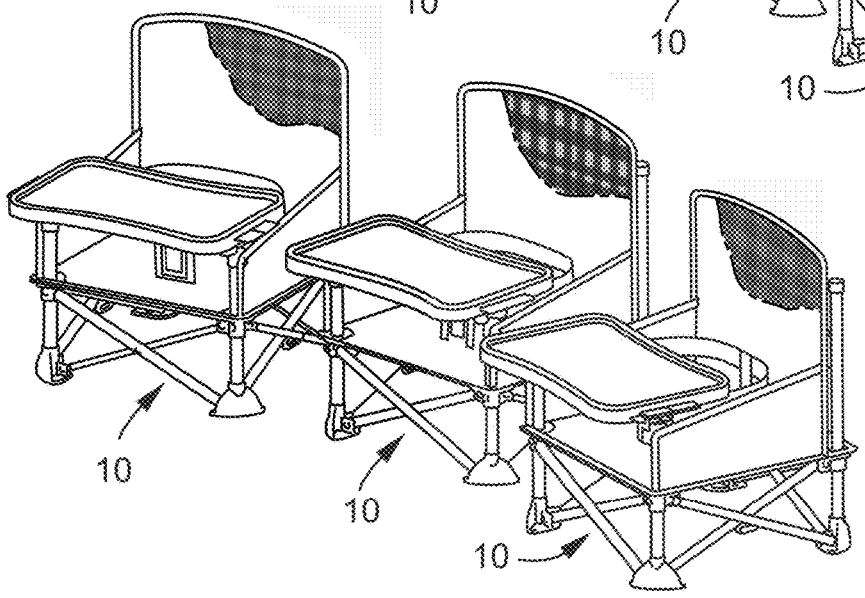
FIG. 17C is a perspective view of a set of three of the base chairs of FIGS. 1A and 1B showing that the fabric of the chairs can have different patterns.

FIG. 17C shows a set of three base chairs 10 where the fabric body 12, including the back portion 20, seat portion 22, right side arm 24, and left side arm 26, has a plaid pattern. Each of the chairs 10 of the set of FIG. 17C has a fabric body 12 of a plaid pattern of different colors.

As to base chair 10, the Flannery U.S. Pat. No. 7,422,276 B2 issued Sep. 9, 2008 and entitled Folding Child Booster Seat is hereby incorporated by reference in its entirety.

As already indicated herein, FIGS. 5A to 5G show a base 196. FIGS. 5A to 5G also show that the first foot 198 on the first leg 46 includes a first base portion. The first base portion is one-piece and integral with the receptor 171. The first base portion has a first undersurface that defines a first plane. The first base portion is on the first side of the first foot 198. The first base portion has a first structure that includes a metatarsus portion 200, three toes 202, two interdigital webs 204, and three claws 206. The first foot 198 on the first leg 46 includes a second base portion. The second base portion has a second undersurface that is disposed in the first plane defined by the first undersurface of the first base portion. The second base portion is one-piece and integral with the receptor 171. The second base portion is on the second side of the first foot 198. The second base portion has a second structure 166. The first structure has a shape different from the second structure 166. The first structure includes two sections, with the two sections being one of a) identical to each other and 2) mirror images of each other, with one of the two sections including a metatarsus portion 200, three toes 202, two interdigital webs 204, and three claws 206, and with the other of the two sections including a metatarsus portion 200, three toes 202, two interdigital webs 204, and three claws 206.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A chair apparatus for children, comprising:

a) a chair for a child, the chair including a seat portion and a back portion;

b) a set of first, second, third, and fourth legs engaged to the chair;

c) a set of first, second, third, and fourth feet engaged, respectively, on the first, second, third, and fourth legs;

d) the first foot on the first leg comprising:

i) a receptor for the first leg, the receptor engaging the first leg;

ii) a first mount, the first mount pivotally engaging a first oblique support at a first end of the first oblique support, a second end of the first oblique support engaging the second leg;

iii) a second mount, the second mount pivotally engaging a second oblique support at a first end of the second oblique support, a second end of the second oblique support engaging the third leg;

iv) the first and second mounts defining a first angle greater than 180 degrees and a second angle less than 180 degrees, the first angle defining a first side of the first foot, the second angle defining a second side of the first foot;

v) a first base portion, the first base portion being one-piece and integral with the receptor, the first base portion having a first undersurface that defines a first plane, the first base portion on the first side of the first foot, the first base portion having a first structure;

vi) a second base portion, the second base portion having a second undersurface that is disposed in the first plane defined by the first undersurface of the first base portion, the second base portion being one-piece and integral with the receptor, the second base portion on the second side of the first foot, the second base portion having a second structure; and vii) the first structure having a shape different from the second structure.

2. The chair apparatus of claim 1, wherein the first base portion comprises a first platform section, the first structure rising integrally from said first platform section, and the first structure extending integrally from the receptor.

3. The chair apparatus of claim 1, wherein the first structure includes said first undersurface, the first structure extending integrally from the receptor.

4. The chair apparatus of claim 1, wherein the second base portion comprises a second platform section.

5. The chair apparatus of claim 1, wherein the first structure includes two sections, said two sections being one of a) identical to each other and 2) mirror images of each other.

6. The chair apparatus of claim 1, wherein the first structure comprises a shape of a toe having a claw extending from the toe.

7. The chair apparatus of claim 1, wherein the first structure comprises a shape of a webbed foot.

8. The chair apparatus of claim 1, wherein the first structure comprises a shape of a hoof.

9. The chair apparatus of claim 1, wherein the first structure comprises a shape of a staircase, the staircase comprising circumferentially extending steps.

10. The chair apparatus of claim 1, wherein the first structure comprises the shape of a staircase, the staircase comprising a set of co-axial curving steps, each of the steps having a curving rise and a curving run.

11. The chair apparatus of claim 1, wherein the first structure includes said first undersurface, wherein the first structure includes a first intermediate section and a second intermediate section, the first intermediate section being convex from the first undersurface to the second intermediate section, the second intermediate section being concave from the first intermediate section to the receptor.

12. The chair apparatus of claim 1, wherein the first structure is on said first base portion, wherein the first structure includes a first section, a second section, and a U-shaped junction therebetween, the first section being convex from the first base portion to the second section, the second section being concave from the first section to the receptor, and the second section having a U-shaped junction with the receptor.

13. The chair apparatus of claim 1, wherein the first structure is on said first base portion, wherein the first base portion includes a perimeter, wherein the receptor includes a top edge, wherein the first structure extends from the top edge of the receptor to the perimeter of the first base portion, wherein the first structure includes first and second triangular end walls, each of the first and second triangular end walls having first, second, and third edges, the first edge defining a straight junction with the first base portion, the second edge defining a straight junction with the receptor, and the third edge extending from the receptor to the perimeter of the first base portion, the first structure having a front surface running from the top edge of the receptor to the perimeter of the first base portion, the front surface having a convex surface portion extending from the perimeter of the first base portion, the convex surface portion leading into a concave surface portion that leads into the top edge of the receptor.

14. The chair apparatus of claim 1, wherein the first structure is on said first base portion, wherein the first base portion includes a perimeter with a corner, wherein the receptor includes a top edge, wherein the first structure extends from the top edge of the receptor to the perimeter of the first base portion, wherein the first structure includes first and second triangular end walls, wherein the first structure includes a pair of flat outer surfaces running from the top edge of the receptor to the perimeter of the first base portion, wherein the first structure includes an inner convex surface running from the top edge of the receptor to the corner of the perimeter, the inner convex surface being between the flat outer surfaces and defining a U-shaped junction therebetween, the U-shaped junction running from the top edge of the receptor to the corner of the perimeter.

15. The chair apparatus of claim 1, wherein the receptor includes a top edge, wherein the first structure includes a trapezoidal wall that extends from top edge of the receptor to the first undersurface, wherein the first structure includes first and second convex portions extending from the top edge of the receptor to the first undersurface, the trapezoidal wall being between the first and second convex portions.

16. The chair apparatus of claim 1, wherein the first structure includes a generally diamond shaped flat surface portion nestled in a diamond shaped perimeter of convex portions, the generally diamond shaped flat surface portion forming a top edge portion of the receptor.

17. The chair apparatus of claim 1, wherein the first structure is on said first base portion, wherein the first base portion includes a perimeter, wherein the receptor includes a top edge, wherein the first structure extends from the top edge of the receptor to the perimeter of the first base portion, wherein the first structure is conical, wherein the first structure is disposed 180 degrees opposite of one of the first and second mounts.

* * * * *